US005944444A

United States Patent [19]

Motz et al.

[11] Patent Number: 5,944,444

[45] Date of Patent: Aug. 31, 1999

[54] CONTROL SYSTEM FOR DRAINING, IRRIGATING AND HEATING AN ATHLETIC FIELD

[75] Inventors: Joseph E. Motz; Mark A. Heinlein, both of Cincinnati; James B. Goddard, Powell; Carl Tyner, Hamilton, all of Ohio; Craig Reese, Roanoke; Brian L. Ferry, Ft. Wayne, both of Ind.

[73] Assignees: Technology Licensing Corp.; Advanced Drainage Systems, Inc.; Murray Equipment

[21] Appl. No.: 08/909,191

[22] Filed: Aug. 11, 1997

Related U.S. Application Data

[63] Continuation-in-part of application No. 08/390,556, filed as application No. PCT/US96/02207, Feb. 16, 1996, Pat. No. 5,752,784.

[51] Int. Cl.[6] ..... F02B 11/00; F16K 17/36

[52] U.S. Cl. ..... 405/37; 405/36; 405/130; 405/131; 137/78.2; 137/561 R

[58] Field of Search ..... 405/36, 37, 130, 405/131; 137/78.2, 78.3, 561 R; 165/45; 126/343.5 R

[56] References Cited

U.S. PATENT DOCUMENTS

| | | | |
|---|---|---|---|
| 1,895,324 | 1/1933 | Heacock | 405/39 |
| 2,432,887 | 12/1947 | Haviland . | |
| 3,425,555 | 2/1969 | Ridgeway . | |
| 3,706,319 | 12/1972 | Neese et al. . | |
| 3,908,385 | 9/1975 | Daniel et al. . | |
| 4,023,506 | 5/1977 | Robey . | |
| 4,246,925 | 1/1981 | Oldfelt . | |
| 4,268,993 | 5/1981 | Cunningham . | |
| 4,293,237 | 10/1981 | Robey et al. . | |
| 4,333,487 | 6/1982 | Michael . | |
| 4,333,830 | 6/1982 | Michael . | |
| 4,339,232 | 7/1982 | Campbell . | |
| 4,462,184 | 7/1984 | Cunningham . | |

(List continued on next page.)

FOREIGN PATENT DOCUMENTS

| | | | |
|---|---|---|---|
| 437423 | 1/1971 | Australia . | |
| 111978 | 9/1964 | Czechoslovakia . | |
| 0199598A3 | 4/1987 | European Pat. Off. . | |
| 2405330 | 6/1979 | France . | |
| 2569434A1 | 2/1986 | France . | |
| 924931 | 3/1955 | Germany . | |
| 938850 | 2/1956 | Germany . | |
| 1910641 | 9/1970 | Germany . | |
| 1945067 | 9/1971 | Germany . | |
| 2525114 | 12/1976 | Germany . | |
| 2549558A1 | 5/1977 | Germany . | |
| 2727954A1 | 1/1979 | Germany . | |
| 2727955A1 | 1/1979 | Germany . | |
| 2727956A1 | 1/1979 | Germany . | |
| 2840389A1 | 3/1980 | Germany . | |
| 4017115A1 | 12/1990 | Germany . | |
| 482615 | of 1953 | Italy . | |
| 475980 | 6/1973 | U.S.S.R. . | |
| 1535942 | 1/1990 | United Kingdom | 405/131 |
| 2244902 | 12/1991 | United Kingdom | 405/131 |
| 2274161 | 7/1994 | United Kingdom . | |

*Primary Examiner*—David J. Bagnell
*Assistant Examiner*—Jong-Suk Lee
*Attorney, Agent, or Firm*—Wood, Herron & Evans, L.L.P.

[57] ABSTRACT

A control system for an athletic field coordinates drainage by gravity or vacuum-enhanced and irrigation by monitoring water level with respect to a subsurface membrane, wherein a flow network resides on the membrane and is covered by a fill layer, which in turn supports the field surface thereabove. The flow network includes couplings located at the intersections of some of the pipe rows and conduit rows. The water permeability of the conduit rows allows the flow network to be used for draining, irrigating or heating the field. The heating of the fill layer and the surface thereabove minimizes energy costs and eliminates installation and maintenance costs that would otherwise be necessitated by separate heating and draining systems.

14 Claims, 7 Drawing Sheets

U.S. PATENT DOCUMENTS

| | | | |
|---|---|---|---|
| 4,576,511 | 3/1986 | Vidal, Jr. . | |
| 4,704,047 | 11/1987 | Oldfelt et al. . | |
| 4,832,526 | 5/1989 | Funkhouser, Jr. . | |
| 4,881,846 | 11/1989 | Burkstaller . | |
| 4,904,113 | 2/1990 | Goddard et al. . | |
| 4,913,596 | 4/1990 | Lambert, III . | |
| 4,930,934 | 6/1990 | Adkins . | |
| 4,932,257 | 6/1990 | Webb | 405/52 |
| 4,948,294 | 8/1990 | Mercier . | |
| 4,982,788 | 1/1991 | Donnelly | 405/131 |
| 5,064,308 | 11/1991 | Almond et al. . | |
| 5,074,708 | 12/1991 | McCann, Sr. . | |
| 5,120,157 | 6/1992 | Todd, Sr. et al. . | |
| 5,120,158 | 6/1992 | Husu . | |
| 5,163,781 | 11/1992 | Husu . | |
| 5,219,243 | 6/1993 | McCoy . | |
| 5,221,158 | 6/1993 | Norsworthy . | |
| 5,222,831 | 6/1993 | Todd, Sr. et al. . | |
| 5,350,251 | 9/1994 | Daniel et al. . | |
| 5,368,092 | 11/1994 | Rearden et al. . | |
| 5,718,221 | 2/1998 | Lobato | 126/343.5 R |
| 5,718,485 | 2/1998 | Katsuragi et al. | 165/45 |
| 5,752,784 | 5/1998 | Motz et al. | 405/37 |
| 5,788,412 | 8/1998 | Jatkar | 405/131 X |

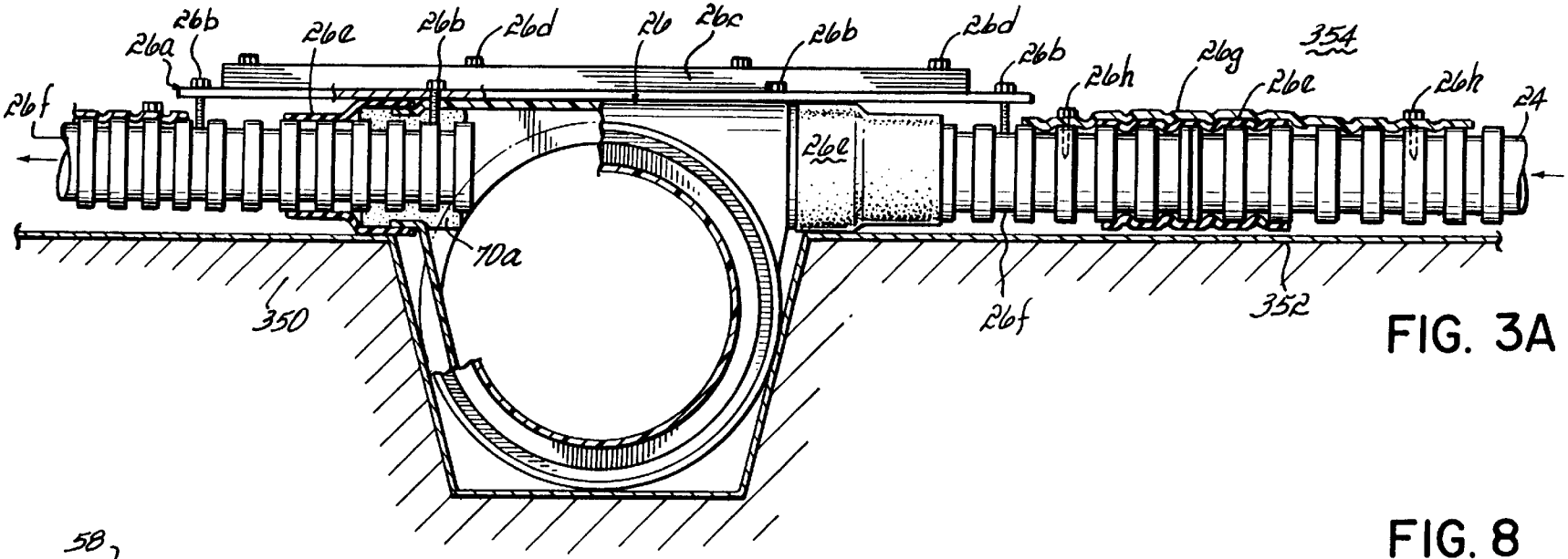
FIG. 3A
FIG. 8
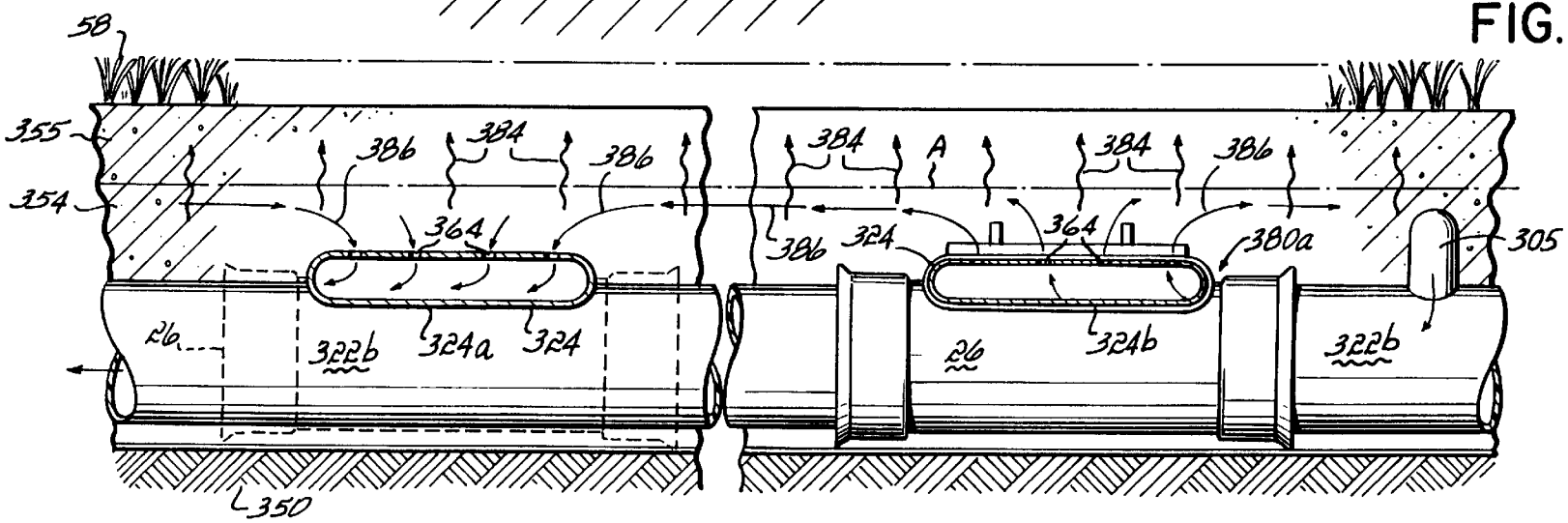

CONTROL SYSTEM FOR DRAINING, IRRIGATING AND HEATING AN ATHLETIC FIELD

FIELD OF THE INVENTION

This is a continuation-in-part of U.S. patent application Ser. No. 08/390,556 filed Jan. 17, 1995 which issued as U.S. Pat. No. 5,752,784 on May 19, 1998 and a continuation of PCT Application Ser. No. PCT/US96/02207 filed Feb. 16, 1996, each of which is incorporated herein reference in their entirety.

Generally, this invention relates to a drainage network for an outdoor athletic surface. More particularly, this invention relates to a low profile drainage network and a control system which form part of a drainage system for a natural turf athletic field, for advantageous use in gravity or vacuum-enhanced drainage of the field, and advantageous integration of gravity drainage, vacuum-enhanced drainage, irrigation and heating of the field, in an automatic mode of operation.

BACKGROUND OF THE INVENTION

Daniel et al. U.S. Pat. No. 3,908,385, issued Sep. 30, 1975 and entitled "Planted Surface Conditioning System", discloses a drainage system which utilizes vacuum to promote drainage of a natural turf athletic field. The system includes a water impermeable membrane over a compacted subsoil, covered by a fill layer of sand with a drainage network buried therein and a natural turf playing surface on top. Some of the pipes in the drainage network are fluid permeable, and vacuum may be applied to the network to assist gravity drainage during periods of heavy rainfall. Even without this feature of vacuum-enhanced drainage, the configuration of the subsurface components, and particularly the use of a horizontal water impermeable membrane, provides advantages in controlling the water level in the system.

Turf science and maintenance play significant roles in the performance of any vacuum-enhanced or water level controlled natural turf field. However, the relatively high initial cost of buying and installing the components of such a system are probably the most important factors considered when the decision to purchase such a system is made. Thus, while there exists a growing desire for such systems in the market, the systems must meet or exceed performance expectations when in use, and they must also be economically feasible at the outset. Due to ever-tightening budgets, even the most successful professional and university teams are extremely cost-conscious about their athletic facilities.

Partially in recognition of these economic realities, Mr. Daniel improved upon his original athletic field drainage system with vacuum-enhanced drainage capability. These improvements are set forth in U.S. Pat. No. 5,350,251, issued Sep. 27, 1994 and entitled "Planted Surface Moisture Control System". The system disclosed in Daniel '251 results in reduced installation and construction costs for a drainage system by eliminating the underground concrete vacuum pump pits used in earlier systems. Daniel '251 indicates that such underground concrete pump pits were relatively expensive, were required to meet stringent building requirements which varied from community to community, and sometimes required the removal of existing stadium sections.

Thus, one primary objective of the system of Daniel '251 related to reducing the cost of the vacuum-enhanced drainage feature for an athletic field drainage system. It is an object of this invention to follow this lead one step further, to further reduce the time and costs associated with installing and constructing a drainage system for an athletic field, with or without vacuum-enhanced drainage capability.

Many small colleges or high schools simply cannot afford to spend the relatively large amounts of money on athletic facilities that are spent by some professional teams or major universities. Nevertheless, for these entities, there still remains a strong desire to obtain the best facilities possible within the given financial constraints. This includes the desire to purchase and install natural turf athletic fields which have the advantages of consistent drainage, a level playing surface and the ability to exercise some degree of control over the moisture content of the natural turf and the fill layers residing therebeneath, regardless of whether or not the system also provides the feature of vacuum-enhanced drainage to accommodate periods of heavy rainfall. It is another object of the invention to meet the needs of these entities by improving the degree of control over the drainage or moisture content of a natural turf athletic field, regardless of whether or not achievement of this control includes the feature of vacuum-enhanced drainage.

Some entities may desire an athletic field with optimum capabilities, particularly vacuum-enhanced drainage, but this desire for these optimum capabilities may not become apparent until after a prior system has already been installed. In these instances, there is a need to supply improved features for an athletic field, such as vacuum-enhanced drainage, after the system has already been installed. Accordingly, it is still another object of the invention to facilitate the upgrading of an in-place drainage system for an athletic field, to add improvement features such as vacuum-enhanced drainage.

For a number of presently in-place systems which provide vacuum-enhanced drainage for an athletic field, the systems were originally designed to achieve vacuum-enhanced drainage in an automatic mode. Some systems were also designed to provide subirrigation or overhead irrigation in an automatic mode. Based on experience and knowledge in this field, applicants have concluded that these systems generally have not achieved a high degree of reliability in delivering this automatic mode of operation. In other words, applicants have concluded that automatic sensing of excess or insufficient moisture within the system, for the purpose of automatically initiating vacuum drainage or subirrigation (and/or overhead irrigation), respectively, has worked better in theory than in practice. Also, these so-called automatic systems have not satisfactorily integrated gravity drainage and vacuum-enhanced drainage.

Therefore, it is still another object of the invention to increase the reliability of athletic field drainage systems which include automatic control of features such as vacuum-enhanced drainage or irrigation cycles, and to do so in a manner which also integrates gravity flow drainage.

Applicants have also come to recognize that regardless of the degree of complexity and/or the number of features provided by a drainage system for an athletic field, consistent and uniform gravity drainage of excess water remains one of the most important features of an athletic field. To achieve consistency and uniformity in the gravity drainage of excess water from an athletic field, most fields incorporate a drainage pipe system buried beneath the turf. In installing such a drainage pipe system, grading the subsurface to a desired level within a predetermined tolerance and then locating the drainage network beneath the subsurface grade represents a substantial cost. Also, the labor costs associated with interconnecting the separate pieces of drainage pipe are relatively high, due to the time required to lay out and interconnect the separate piping pieces at different horizontal levels. These different horizontal levels also present the problem of determining the optimum level for placement of moisture sensors, for automatic mode of operation.

It is still another object of this invention to reduce the costs associated with constructing and installing a drainage network beneath a natural turf athletic field, and to simplify and remove the uncertainty associated with locating and installing moisture sensors used for automatic operation.

For some geographical areas it is difficult to maintain a healthy condition of the natural turf due to extended periods of cold weather, and eventual freezing of the ground. A number of prior systems for heating natural turf athletic fields have utilized electric cable heaters to either thaw the ground or keep it from getting frozen. Other systems for heating fields utilize heated air, steam or water, usually with the heating fluid remaining within a dedicated heat distribution and radiation network. Unfortunately, such systems typically require use of relatively high amounts of electrical energy. Moreover for those fields which use a separate subsystem for heating the field, the existence of two distinct subsystems tends to complicate installation, operation and/or maintenance of both subsystems.

It is still another objective of the invention to increase cost efficiency and energy efficiency in heating a natural turf field during periods of cold weather, and to do so in a manner which does not significantly increase the complexity or cost of installing, operating or maintaining the field system.

SUMMARY OF THE INVENTION

The present invention achieves the above-stated objectives by simplifying interconnection of the structural components of a flow or drainage network of a drainage system for an athletic field, lowering the vertical profile of the drainage network and reducing the excavation and grading costs associated with installing the drainage network. More specifically, the invention achieves these features primarily via use of a plurality of low vertical profile couplings, each coupling located at an intersection of a pipe row partially recessed in a compacted subsoil and a perpendicularly oriented conduit row residing on the subsoil.

The drainage network includes a plurality of parallel rows of water impermeable pipes oriented perpendicular to and intersecting a plurality of parallel rows of water permeable conduits. At each of the plurality of intersections of the pipe rows and the conduit rows, a coupling provides fluid connection between a respective water impermeable pipe and a respective water permeable conduit. The vertical dimension of the coupling is less than the combined vertical dimensions of the pipe rows and the conduit rows. In effect, the coupling allows vertical overlapping of the pipe rows with the conduit rows. This enables the drainage network to be positioned relatively close to the upper surface of the natural turf, or upper surface, of the athletic field, thereby reducing the overall volume of relatively expensive fill layers located between the turf and the subsoil. Preferably, to enhance structural integrity, a reinforcement plate is secured to the top of each coupling, with the plate spanning the coupling and helping to secure the interconnection of the water permeable conduits.

Because of the structural configuration and the manner of interconnecting the couplings, the couplings accommodate a plurality of parallel pipe rows which rest on the graded subsoil and a plurality of pipe rows which are partially recessed within depressions excavated in the subsoil. Thus, only placement of the pipe rows, of which there are only five in a typical U.S. football field layout, requires digging below the major portion of the level-graded, compacted subsoil. Compared to prior systems, this minimum excavation significantly simplifies the step of installing the drainage network, regardless of whether the feature of vacuum-enhanced drainage is also provided for the drainage system.

The system preferably uses a water impermeable membrane, or barrier, between the drainage network and the compacted subsoil. The conduit rows rest directly on the membrane above the parallel, major portions of the compacted subsoil. The membrane also extends downwardly into the parallel depressions in the subsoil, so that the membrane in all places resides between the drain network and the subsoil. The water impermeable membrane effectively creates an artificial water table for the natural turf athletic field, to facilitate control of the water level in the field by reference to the level of the water above the membrane. This feature is advantageous for both gravity drainage and vacuum-enhanced drainage of the field.

The low profile couplings also help to reduce the costs associated with installing the membrane. More specifically, the parallel depressions in the compacted subsoil represent the only non-flat surfaces into which the membrane must extend downwardly. Unlike many prior systems which typically had numerous intersecting depressions that made it difficult to completely recess a non-stretchable membrane therein, due to the membrane roll being oriented perpendicular to some of the depressions and parallel to others, for this system it is relatively easy to extend a membrane into a plurality of depressions which are all parallel. The step of installing the membrane does not unnecessarily stress or rip the membrane. Simply providing enough extra "slack" will enable the membrane to conform to the entire graded subsoil, on the flat portions and in the depressions.

According to a preferred embodiment of the invention, a drainage system for an athletic field includes: a water impermeable membrane conforming to a compacted, graded subsoil having a plurality of parallel depressions formed therein and extending along the length of the field; a flow or drainage network located above the membrane and having parallel pipe rows partially recessed within the parallel subsoil depressions and a plurality of conduit rows oriented perpendicular to the pipe rows and located above the non-depressed areas of the compacted subsoil; and a plurality of couplings, each coupling located at an intersection of a pipe row and a conduit row and forming a fluid interconnection thereat.

A fill layer fills in the volume between the membrane and an upper surface of the field, for the volume not occupied by the drainage network. For a natural turf athletic field, an upper portion of the fill layer includes a subsurface rooting medium, including fertilizer, for sustaining the natural turf located thereabove. The drainage network operatively connects to a main pipeline located along one end of the athletic field, and one end of the main pipeline flows to a storm drain, or sewer. The main pipeline leading to the storm drain includes a wet pit with a vertically adjustable upstack located therein, and a valve downstream of the upstack. A drain connects to the wet pit for draining the wet pit and the network by gravity. By selecting the vertical level of the top of the upstack with respect to the vertical level of the membrane, and with the valve closed, the system permits gravity drainage of water therefrom when the water level raises above the top of the upstack.

With these components, this invention achieves a relatively inexpensive drainage system for an athletic field, wherein the field has the features of a level playing surface and uniformity and consistency in gravity drainage. Because of the adjustability of the upstack with respect to the membrane, this system provides a good degree of control over the water level in the field. By selectively setting the vertical position of the upstack with respect to the barrier, the system retains some water in the network. If this amount of retained water is higher than the membrane, the water retained in the network will eventually be absorbed upwardly toward the turf through the fill layer, via capillary action, known in the industry as "wicking".

The invention also contemplates the components necessary for achieving vacuum-enhanced drainage. More particularly, the invention contemplates a subsystem of components which includes: a vacuum drainage line connected to the main pipeline along the first end of the field; a valve located along the vacuum line; a water collection and vacuum tank located at the end of the vacuum/drainage line and which is preferably located below the horizontal level of the field but preferably somewhere off to the side of the field; an air line operatively connected to the buried tank; and a vacuum pump connected to the air line and remotely located with respect to the vacuum tank, and preferably above ground. The vacuum tank retains a small amount of water in its bottom, and submersible pumps mounted on the bottom of the vacuum tank. below the residual water level, pump excess water out of the tank to the drain end of the main pipeline.

To provide vacuum-enhanced drainage, the valve along the vacuum line is opened, and the vacuum pump is actuated to apply vacuum to the fill layer under the surface of the athletic field via the air line, the buried tank, the valve, the vacuum/drainage line, the main pipeline, the pipe rows and the water permeable conduit rows. Also, at least one additional valve is included along the gravity drain line, i.e. through the wet pit, so that this portion of the network may be closed off, or isolated, during vacuum-enhanced drainage.

The components of this subsystem may be included with initial installation of the system, or they may be added to provide this improvement feature at a later date. This may happen if initial financial constraints prevent inclusion of this subsystem with initial installation of the athletic field, and/or if the benefits of this vacuum-enhanced drainage feature become more apparent and more appreciated sometime after installation, and the owner deems the addition of this feature to be necessary or desired. Because of the interrelationship of these subsystem components with respect to the basic, gravity drainage system previously described, this invention facilitates the updating of an in-place system to provide vacuum-enhanced drainage.

If this subsystem is installed initially, the wet pit, the upstack and wet pit valve may be eliminated, thereby to route all drainage through the buried vacuum tank. This would also eliminate the need for a valve adjacent the buried tank, but it would result in the need to pump from the tank, via the submersible pumps, all water which drains from the system. For this reason, this configuration is not preferred.

In a related aspect of the invention, the vacuum-enhanced drainage feature may be provided in an automatic mode of operation. To accomplish this mode of operation, the system further includes a plurality of sensors buried underneath the athletic field, within the fill layer and supported on the membrane. Each sensor includes a water permeable housing located directly on the membrane. Each sensor measures the water level with respect to the membrane, and this water level is sensed in the housing, away from the fill layer. The sensors convert these water level measurements into electrical signals which are supplied via buried electrical lines to a controller. The controller operatively connects to the vacuum. When the sensor senses a predetermined high water level above the membrane, it generates a signal to the controller to automatically signal the vacuum-enhanced drainage subsystem components, thereby to initiate vacuum-enhanced drainage. Vacuum-enhanced drainage typically continues until the sensors stop sensing the water level at the predetermined high level, i.e. when the water level recedes. In this manner, the controller may cycle the vacuum-enhanced drainage feature on and off, as necessary. Because the sensors are located right on the membrane and measure the depth or vertical level of the water with respect to the membrane, the water level measurements are extremely reliable, and the measurements do not suffer from the problems typical of prior electrical conductivity sensors which measured "water content" based on soil conductivity. If the system includes a wet pit with a valve and upstack, and/or a valve adjacent the buried tank, depending on the configuration of the system, the positions of these valves are preferably operated by the controller, to connect the tank to the network and to disconnect or isolate the wet pit and the gravity drain line from the network.

Additionally, the basic system may be used to subirrigate the athletic field. Subirrigation is done by closing off the valve in the wet pit and then supplying water to the main pipeline. This fills the main pipeline of the drainage network to a vertical level above that of the membrane, to a level determined by the upstack. As a result, water flows outwardly from the drainage network, flows into the fill layer and eventually wicks upwardly to the turf.

Again, as with the vacuum-enhanced feature, this subirrigation feature may be provided in an automatic mode by initiating the subirrigation procedure in response to detection of a low water level above the membrane. If desired, subirrigation may be automatically initiated if a low water level is determined for a predetermined period of time deemed to be excessive with respect to the water needs for the field. Alternatively, the system may initiate overhead irrigation by activating sprinkler heads buried in the field, adjacent the surface.

Additionally, the sensors and the controller may be used to cooperatively integrate the functions of gravity drainage, vacuum-enhanced drainage and irrigation. In this way, each sensor includes a probe located inside its respective water permeable housing. The probe senses at least three discrete water levels spaced above the barrier, in an effort to maintain a desired water level above the barrier. More specifically, the probe senses a first vertical level above the desired level, and in response, the sensor generates a signal to the controller to activate gravity drainage. If the water level continues to rise and the probe senses water at a second vertical level (above the first level), the sensor generates a different signal to the controller to terminate gravity drainage and to activate vacuum-enhanced drainage. When the water level eventually recedes, the controller first deactivates vacuum-enhanced drainage and activates gravity drainage, and upon continual receding of the water, the controller eventually deactivates gravity drainage so that no further drainage occurs. If the water falls below the desired maintenance level, to a third vertical level, the probe generates a signal to the controller to activate the irrigation system, which may be subirrigation by supplying water directly to the flow network, or above-ground sprinkling by supplying water to a sprinkler system with buried sprinkler heads. This manner of operation maintains a desired water level above the barrier, which corresponds to a desired moisture content for the fill layer of the field.

According to another aspect of the invention, the drainage network may be reconfigured during installation to provide continuous "closed loop" heating of the field in an automatic mode, by simultaneously delivering heated water to the fill layer while draining cooled water therefrom. To do this, at every other intersection of pipe rows and conduit rows, the pipes and conduits are left unconnected, without a coupling. This means that at each of these "bypass" intersections the conduit row simply lays over the respective pipe row.

Instead of all of the pipe rows connecting directly to the main drain line which feeds the gravity drainage and the vacuum-enhanced drainage subsystems, only a predetermined number of "drain only" pipe rows are so connected. Typically, this will be two, three or four pipe rows. The other pipe rows, referred to as "dual purpose" pipe rows, are equipped with isolation valves to selectively close off access to the gravity drainage and vacuum-enhanced drainage subsystems during operation in a heating mode. Each dual purpose pipe row is also connected to a hot water supply line. Each of the hot water supply lines operatively connects to a heat source, such as a heat exchanger, which in turn operatively connects at its input to the main drain line and the "drain only" pipe rows, to form a "closed loop." A circulation pump is also included in this loop. In this manner, with the isolation valves closed, the dual purpose pipe rows are routed to the heat exchanger, rather than to the gravity drainage subsystem or the vacuum-enhanced subsystem. This subsystem is "closed" in that the inlet and outlet of the heat exchanger connect to the drainage network and all components are water filled. Yet this subsystem is "open" in that the conduits are water permeable, and they allow water flow to and from the fill layer.

Additionally, temperature probes are located in the fill layer and/or outside the stadium, if desired. The probes detect a predetermined low temperature and in response thereto generate a "low temperature" signal to the controller, which is operatively connected to the recirculation pump, the isolation valves, the heat exchanger, and the gravity drainage and vacuum-enhanced drainage subsystems. To initiate heating, the controller closes the isolation valves to place the "dual purpose" pipe rows in "heat" mode, closes the valves to the gravity drainage and vacuum-enhanced drainage subsystems so that no water will be drained out of the system and activates the heat exchanger and the circulation pump. If desired, the heat exchanger may be activated first, during a warm-up period, to provide sufficient heat to raise the temperature of the water of the outlet of the heat exchanger to a desired temperature, preferably about 65° F. At the inlet to the heat exchanger, the water temperature should be about 55° F.

The pump circulates the heated water into the "dual purpose" pipe rows, preferably from both ends of each of these rows. Because the system maintains a normal liquid operating level which is above the entire drainage network, the fill layer below this normal level is saturated. By flowing heated water into the flow networks the heat causes it to rise upwardly into the conduit rows, where it then continues to percolate upwardly through the apertures in the conduit rows and into the fill layer. At the same time, because the "drain only" pipe rows remain open to the main drain line and the input of the heat exchanger, water also flows out of the drainage network and the fill layer, at the same rate that is flowing into the drainage network and the fill layer.

Due to the manner of interconnecting the pipe rows and conduit rows, i.e. interconnection at every other intersection, some first regions of the drainage network primarily flow heated water into the fill layer, while other second regions of the drainage network primarily receive cooled water from the fill layer. The relative surface areas of the first regions and the second regions depend on the spacing of the conduit rows and the pipe rows. Generally, the heated water flows out of those conduit rows which are interconnected via couplings to the dual purpose pipe rows, and the cooler water drains into the conduit rows which are interconnected via couplings to the drain only pipe rows. Thus, each first region is surrounded by plurality of second regions, and vice versa. This also means that there is some lateral spacing between those regions of the field where heated water is primarily flowing into the fill layer and those regions where cooler water is primarily flowing out of the fill layer.

The continual lateral flow of heated water through the fill layer causes heating of the root zone for the turf above, due to the adding of heat to the system below the normal water level and some upward wicking action through the saturated fill layer. Thus, with this system the field is heated by simultaneously: flowing heated water into the fill layer and draining relatively cooler water from the fill layer. During this heating of the field by simultaneously supplying heated water to the fill layer while removing relatively cool water therefrom, it is preferable that the water level sensors remain in operation, to thereby assure that the water level remains at the normal operating level with respect to the barrier, so that the entire network remains underwater. If necessary, water can be added prior to or even during operation of the pump and the heat exchanger, to assure a sufficient volume of water in the system to keep the flow network submerged. However, this typically should not be necessary, because even in a nonheat mode the system operates optimally by maintaining, at all times, a level of water sufficiently above the membrane to submerge the pipe network.

Because this heating subsystem uses the same drainage network which is used for gravity drainage, vacuum-enhanced drainage or even subirrigation, this inventive system and method of heating the field eliminates the relatively high cost and complexity of installing and maintaining completely separate subsystems to perform these diverse operations. Moreover, because the water is moderately heated, i.e. only about 10° F., from about 55° F. to about 65° F., via a subsurface heat exchanger and circulated by one continuously operating recirculation pump, the energy costs associated with this heating subsystem are relatively low, compared to prior field heating systems.

This combination of features provides an advantageous athletic field draining system which may be used with the surfaces of any number of sporting activities, including but not limited to, any size American or Canadian style football fields, soccer fields, baseball fields, racetracks for horseracing, golf courses (particularly putting and tee areas), cricket, rugby, etc.

These and other features of the invention will be more readily understood in view of the following detailed description and the drawings.

BRIEF DESCRIPTION OF THE DRAWINGS

FIG. 3A is a cross-sectional view, similar to FIG. 3, of an alternative embodiment of the invention, wherein the coupling is reinforced.

FIG. 8 is a cross-sectional view, taken along lines 8—8 of FIG. 7, which schematically shows water flow during heating of the field.

DETAILED DESCRIPTION OF THE INVENTION

Figure 1:
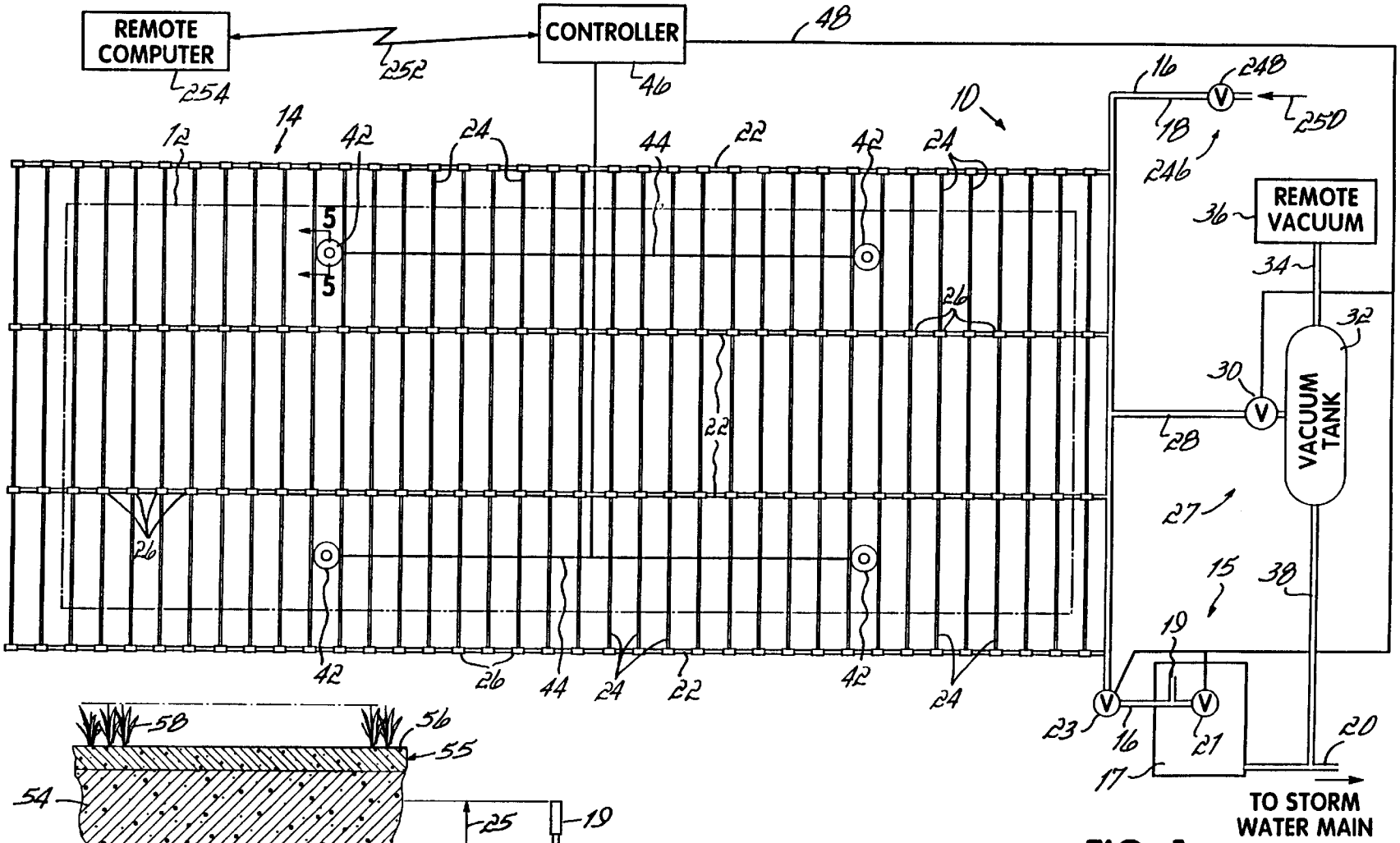
FIG. 1 is a schematic plan view which illustrates an athletic field drainage and irrigation system constructed in accordance with a first preferred embodiment of the invention.

FIG. 1 shows in plan view the components of a low profile drainage system 10 constructed in accordance with a preferred embodiment of the invention. This embodiment of the system 10 includes components necessary for both gravity and vacuum-enhanced drainage, and for subirrigation, if desired. Also, the components which perform vacuum-enhanced drainage, or subirrigation, may be designed to operate in an automatic mode. The components necessary for vacuum-enhanced drainage may be included upon initial installation, or as an enhancement added at a later date to an already in-place system. Even without the components which provide automation of vacuum-enhanced drainage, or even vacuum-enhanced drainage per se, the system 10 provides numerous benefits in draining an athletic field, which is designated by phantom boundary lines 12.

As shown in FIG. 1, the athletic field 12 has a preferable layout of at least 160 feet wide by 360 feet long. These dimensions are large enough to include a typical U.S. football field. The dimensions may be varied to suit the particular athletic activity. For instance, Canadian football requires a field of somewhat greater length, and international soccer fields are also somewhat larger in dimension. As will be readily understood by those of skill in the art, the invention is not limited to the particular length and width dimensions shown in FIG. 1. For instance, the system 10 could be adopted for use with any size football or soccer fields, baseball fields, racetracks for horseracing, golf courses (particularly putting and tee areas), cricket, rugby, etc. Also, while the system 10 is particularly advantageous for a natural turf, or grass, athletic field, the invention contemplates other types of athletic surfaces which do not require a natural grass surface, such as clay tennis courts, etc.

The athletic field 12 shown in FIG. 1 is preferably graded flat, or horizontal, within a specified tolerance. This eliminates difficulties associated with grading a "crown" on the field 12, a step which is usually necessary to facilitate water drainage of a natural turf field. Generally, the system 10 includes a buried flow or drainage network 14 which may also be used for subirrigation. The network 14 includes a main pipeline 16 which is located at a first end of the field 12. One end 18 of the main pipeline 16 provides a water input for subirrigation. This end of the main pipeline 16 is operatively connected to a pressurized water source (not shown). The other end 20 of the main pipeline 16 serves as a water drainage outlet. This end of the main pipeline 16 operatively connects to a storm drain, a sewer or any other structure or conduit for receiving drainage water.

Figure 1A:
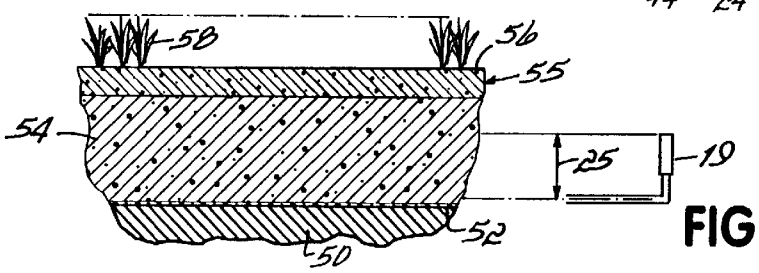
FIG. 1A is schematic cross-section view which illustrates one aspect of gravity drainage of an athletic field drainage system of the type shown in FIG. 1.

A gravity drainage subsystem 15 receives the main pipeline 16 and includes a wet pit 17 located adjacent the field 12. The wet pit 17 is accessible from the surface of the field 12, as by a covered manhole. In the wet pit 17, the main pipeline 16 feeds a vertically extending upstack 19, and the main pipeline 16 terminates at an OPEN/CLOSE valve 21. Thus, the wet pit 17 represents a discontinuity in the main pipeline 16. Water flowing from the athletic field 12 by gravity, via the network 14, flows directly into the wet pit 17 if the valve 21 is open. If the valve 21 is closed, the water eventually flows upwardly into the upstack 19 until the water level becomes higher than the vertical level of the upstack 19. At that point, any additional water flows out of the upstack 19 and into the wet pit 17. All water in the wet pit 17 flows outwardly therefrom, by gravity, to the storm sewer, as shown by arrow 20. During normal gravity drainage operation, the valve 21 remains closed, and the vertical level of the upstack 19 is set to a desired level which corresponds to the maximum desired vertical water level in the system 10, as indicated by reference numeral 25 in FIG. 1A. The variability of the vertical position of the top of the upstack 19 enables the system 10 to better accommodate changes in rainfall during different seasons. Also, considering the different climates in which such fields are used, this variability allows the system 10 to accommodate rainfall differences in different geographic areas.

If desired, water may be supplied to the main pipeline 16 to actively initiate passive subirrigation via the network 14. To accomplish this passive subirrigation, the valve 21 is closed and the upper level of the upstack 19 is located at a desired level above the network 14, so that water supplied to the main pipeline 16 will flow by gravity into the network 14, so long as the water level does not exceed the vertical position of the upstack 19.

The drainage network 14 further includes a plurality of parallel rows 22 of pipes which extend along the length of the athletic field 12 and interconnect with the main pipeline 16 along the first end of the athletic field 12. Preferably, the athletic field 12 includes five pipe rows 22 spaced on centers of about 45 to 55 feet. Preferably, each pipe row 22 comprises a plurality of six inch diameter water impermeable plastic sections interconnected at their ends. The network 14 also includes a plurality of parallel rows 24 of conduits arranged perpendicular to, and intersecting with, the plurality of pipe rows 22. Preferably, the conduit rows 24 are spaced on about 11 foot centers. The conduit rows 24 preferably comprise drain conduits of the type disclosed in Goddard et al. U.S. Pat. No. 4,904,113, issued on Feb. 27, 1990 and entitled "Highway Edgedrain", the disclosure of which is expressly incorporated by reference herein in its entirety. Generally, this patent shows an elongated highway edgedrain flattened on opposing sides. In the system 10, each conduit row 24 is preferably oriented such that the elongated dimension of the edgedrain is horizontally disposed, parallel with the playing surface of the athletic field 12. This minimizes the vertical profile of the system 10 without reducing water carrying capacity. Also, the edgedrain is reinforced along its shorter dimension to reduce the possibility of breakage when the athletic field 12 must bear a relatively heavy load, such as a fork lift or a truck, or other motorized vehicle, as may be necessary for maintenance or other purposes.

The system 10 includes a plurality of couplings 26, each coupling 26 residing at an intersection of a pipe row 22 and a conduit row 24. The couplings 26 serve as fluid interconnections between the pipe rows 22 and the conduit rows 24. These couplings 26, and their interrelationship with the conduit rows 24 and the pipe rows 22, provide some of the primary advantages of the system 10. More specifically, these advantages relate to lower vertical profile for the system 10, enhanced structural integrity for the system 10, lower cost of components for the system 10 and a significant cost reduction and time savings in installation of the system 10.

The above-described system 10 may be enhanced by adding the components for a vacuum-assisted drainage subsystem 27. More specifically, a vacuum/drainage line 28 connects to the main pipeline 16 along the first end of the athletic field 12. An ON/OFF valve 30 resides along the line 28. The vacuum/drainage line 28 interconnects the main pipeline 16 to a water collection and vacuum tank 32, which is preferably located below ground and off to the side of the field 12. An air line 34 operatively connects a remote vacuum 36 to the tank 32. Preferably, the remote vacuum 36 is located above ground, and spaced remotely from the tank 32, as disclosed in Daniel U.S. Pat. No. 5,350,251, entitled "Planted Surface Moisture Control System", the disclosure of which is expressly incorporated by reference herein in its entirety. Another valve 23 resides along main pipeline 16 between the network 14 and the wet pit 17, to isolate the gravity drainage subsystem 15 during vacuum-assisted drainage.

The tank 32 also connects to an outlet drainage line 38, which connects to the outlet end or drain 20 of the main pipeline 16. Preferably, the tank 32 includes one or more submersible pumps (not shown) adjacent the bottom, for pumping water out of the tank 32 to the outlet line 38. A residual amount of water, preferably less than 10–12 inches, remains in the tank 32, to keep the submersible pumps primed.

Together, the vacuum/drainage line 28, the valve 30, the tank 32, the air line 34, the remote vacuum 36 and the drainage line 38 and also the valve 23, cooperate to provide a subsystem for performing the vacuum-enhanced drainage feature for the system 10. As described previously, this feature is particularly useful for draining the athletic field 12 during heavy rainfall. These components are referred to as a separate subsystem, or as a "enhancement", because they are not necessary for obtaining the primary benefits of the system 10. However, these add-on features, or enhancements, offer a higher degree of moisture control for the system 10. Many institutions desire such a feature as part of the initial installation. But for those who decide at a later date, for one reason or another, that this feature is desirable, the present invention readily accommodates retrofitting an in-place system 10 to add this feature.

In a further aspect of this subsystem for performing vacuum-enhanced drainage, particularly for the purpose of automating the control of this subsystem, the system 10 preferably includes a plurality of water level sensors 42 spaced at predetermined positions around the athletic field 12. FIG. 1 shows four such sensors 42, though greater or fewer such sensors 42 may be used, as deemed necessary for the particular surface and/or the athletic activity. The sensors 42 sense the level of water within the entire system 12, and the sensors 42 generate electrical signals used to automatically control switching between gravity drainage and enhanced-vacuum drainage, or even subirrigation or overhead irrigation.

Preferably, to accomplish these features, each of the sensors 42 includes a mechanical float structure for physically sensing the water level in the system 10 and converting the sensed water level to an electrical signal. The sensors 42 connect to buried electrical cables 44 which convey these electrical signals to a master controller 46. The controller 46 may be a programmable logic controller such as a model SLC 503 commercially available from Allen-Bradley of Milwaukee, Wis. The controller 46 operatively connects to the remote vacuum 36, and to valves 30 and 23 via electrical lines 48. Operation of the sensors 42 is described in greater detail with reference to FIG. 5.

Figure 2:
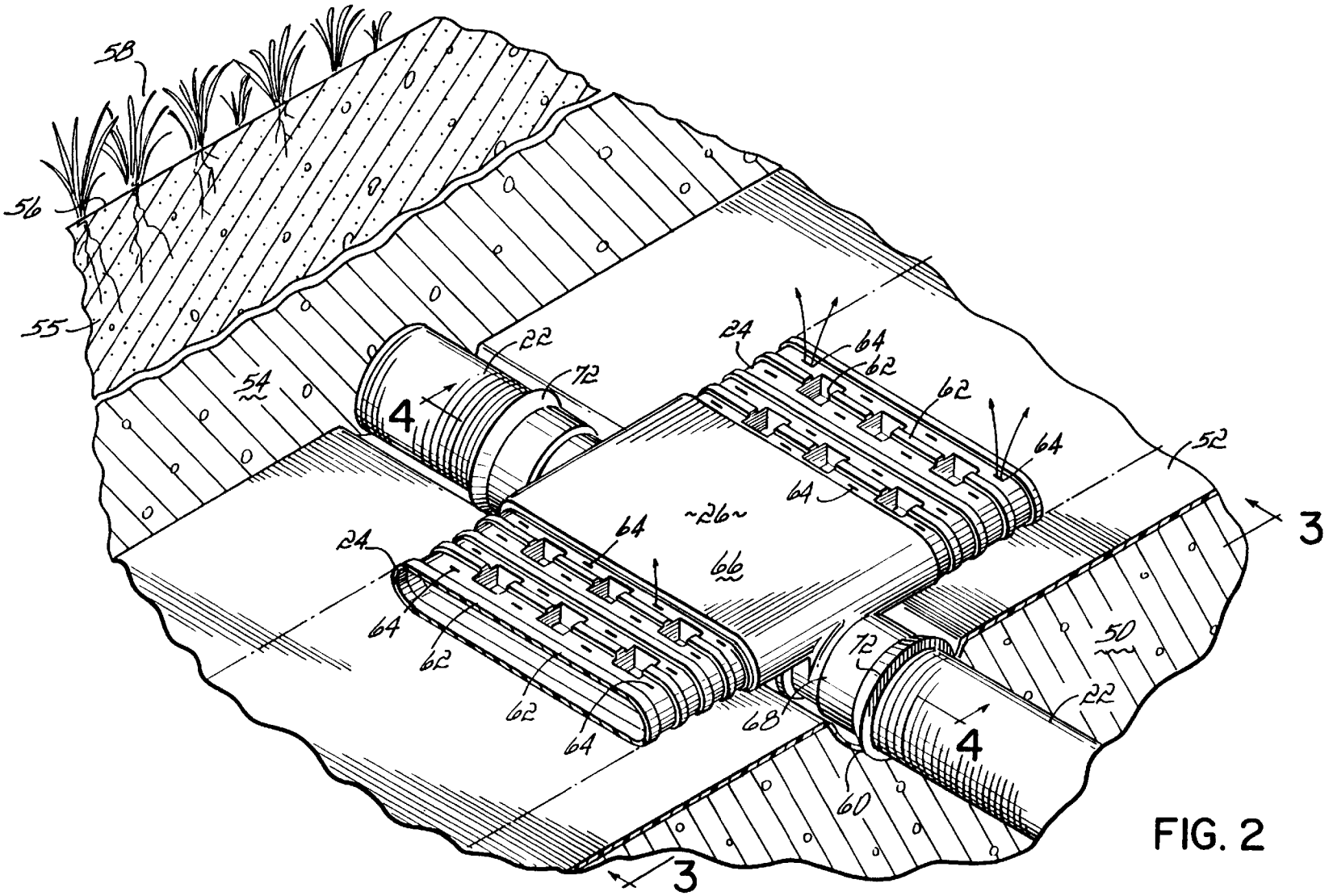
FIG. 2 is a perspective view, partially cut-away, showing a coupling which connects a water permeable conduit to a perpendicularly arranged water impermeable pipe, in accordance with the invention.

FIG. 2 shows one coupling 26 interconnecting one pipe row 22 and one conduit row 24. FIG. 2 also shows in greater detail the level, graded, compacted subsoil 50 located below the system. A water impermeable barrier or membrane 52 resides above the compacted subsoil 50. Preferably, the water impermeable membrane 52 is of polyethylene and has a thickness in the range of 10–20 mils. The membrane 52 rests directly on the parallel major portions of the subsoil 50, which have been graded to be horizontally even, or flat, within a predetermined tolerance. The membrane 52 preferably extends horizontally beyond the length and width dimensions of the field 12, and then extends upwardly to the surface, or adjacent the surface, of the field 12. Thus, the field 12 is contained within the membrane 52. The pipe rows 22 extend through the membrane 52 along the edge of the field 12, preferably where the membrane 52 extends vertically toward the surface.

Excluding the drainage network 14, above the membrane 52 the system 10 includes a layer 54 of uniform porous fill media, such as sand. The sand used is preferably relatively coarse and well graded, i.e. of a grade meeting USGA standards for golf green construction. If desired, an upper portion 55 of the sand layer may be enhanced for turf growth, via components such as peat and/or fertilizers, and possibly synthetic or organic amendments. The upper portion 55 has an upper surface 56 from which planted vegetation such as grass 58 grows. If the system 10 is to be used for an athletic field 12 which does not require natural grass, the upper portion 55 and the grass 58 may be omitted and other materials used. In either case, reference numeral 56 refers to the top surface of the athletic field 12, regardless of the composition.

With regard to the drainage network 14, FIG. 2 shows a pipe row 22 partially recessed within the compacted subsoil 50, within a groove or depression 60 formed therein. During the initial stages of installing the system 10, during the step of compacting and leveling the subsoil 50, a plurality of such parallel grooves 60 are formed along the length of the athletic field 12, at the locations where the pipe rows 22 will be placed. The formation of these parallel depressions 60 represents the only excavation or digging prior to installation of the membrane 52.

Compared to prior systems for providing vacuum-enhanced moisture control of athletic fields, this system 10 does not require criss-crossed or multiple direction excavations to accommodate each of a variety of differently sized rows of piping. Rather, only a plurality of parallel depressions 60 extending along one direction are necessary, i.e. the length of the field 12. In addition to reducing excavation costs, this greatly simplifies the step of conforming the membrane 52 to the compacted subsoil 50. Because the membrane 52 extends downwardly into depressions 60 which are all parallel, with this invention the step of conforming the membrane 52 does not produce undesired stretching or even tearing, as would inevitably occur with the criss-crossed depressions of prior art systems.

While the pipe rows 22 reside partially in depressions 60 within the compacted subsoil 50, the conduit rows 24 rest directly on the membrane 52, on the parallel, undepressed portions of the subsoil 50. As shown in FIG. 2, the conduit rows 24 preferably comprise a tube elongated horizontally, with vertical reinforcing structure 62 formed therein. The tops and bottoms of the conduit rows 24 also include a plurality of apertures 64 which render them fluid permeable. Preferably, each of these apertures 64 has a width in the range of about 0.15 millimeters ("mm") to 0.23 mm (0.006 inches to 0.009 inches), and a length in the range of about 19 mm to 32 mm (0.75 inches to 1.25 inches), so as to render the conduit rows 24 water and air permeable, but to prevent ingress of sand particles. With the pipe rows 22, the use of the low profile, horizontally elongated pipe structure increases drainage water inflow to the network 14 by increasing the soil contact area per unit height, compared to a round shape. Conversely, the pipe rows 22 are water impermeable.

As shown further in FIG. 2, the coupling 26 has upper section walls 66 which define an upper fluid flow channel aligned with the conduit row 24, and lower section walls 68 which define a lower fluid flow conduit aligned with the pipe row 22. These upper and lower fluid flow conduits overlap vertically, and thus are in fluid communication within the coupling 26. The outer ends of the upper section walls 66 are sized and shaped to receive therein the ends of two separate pieces of conduit. Similarly, the lower section walls 68 include enlarged outer ends 72 sized to receive the ends of six-inch diameter pipe.

Interconnection of each coupling 26 with the respective pipe row 24 and conduit row 22 is readily accomplished by hand, without the need for any tools, and results in secure and sturdy interconnection without any fluid leakage. To form the interconnections, a cell-foam or rubber gasket 70 and 71, respectively, is lubricated and then forced over the end of at least one corrugation of the conduit or pipe. The gasket extends radially beyond the corrugations. After insertion of the conduit or pipe into the coupling 26, the gasket bears against the inside of the coupling 26, thereby preventing withdrawal and providing a fluid seal. For both the conduits and the pipes, the gaskets are sized according to the respective perimeters. If desired, the gasket may be non-continuous and rectangular in shape, and wrapped around and adhered to the pipe or conduit as shown by reference numeral 70*a* in FIG. 3A. Because of the simple manner in which the couplings 26 are used to interconnect pipe rows 22 with the conduit rows 24, this invention greatly simplifies installation of the drainage network 14, thereby reducing the overall costs of the system 10.

Preferably, the drainage network 14 uses a single piece of rigid pipe between each two couplings 26 and a single piece of conduit between each two couplings 26. Also, to assure the integrity of the fluid seals at the interconnection of the couplings 26 and the ends of the conduit rows 22, it may be desirable to include an external gasket (not shown), to circumferentially secure the connection.

Figure 3:
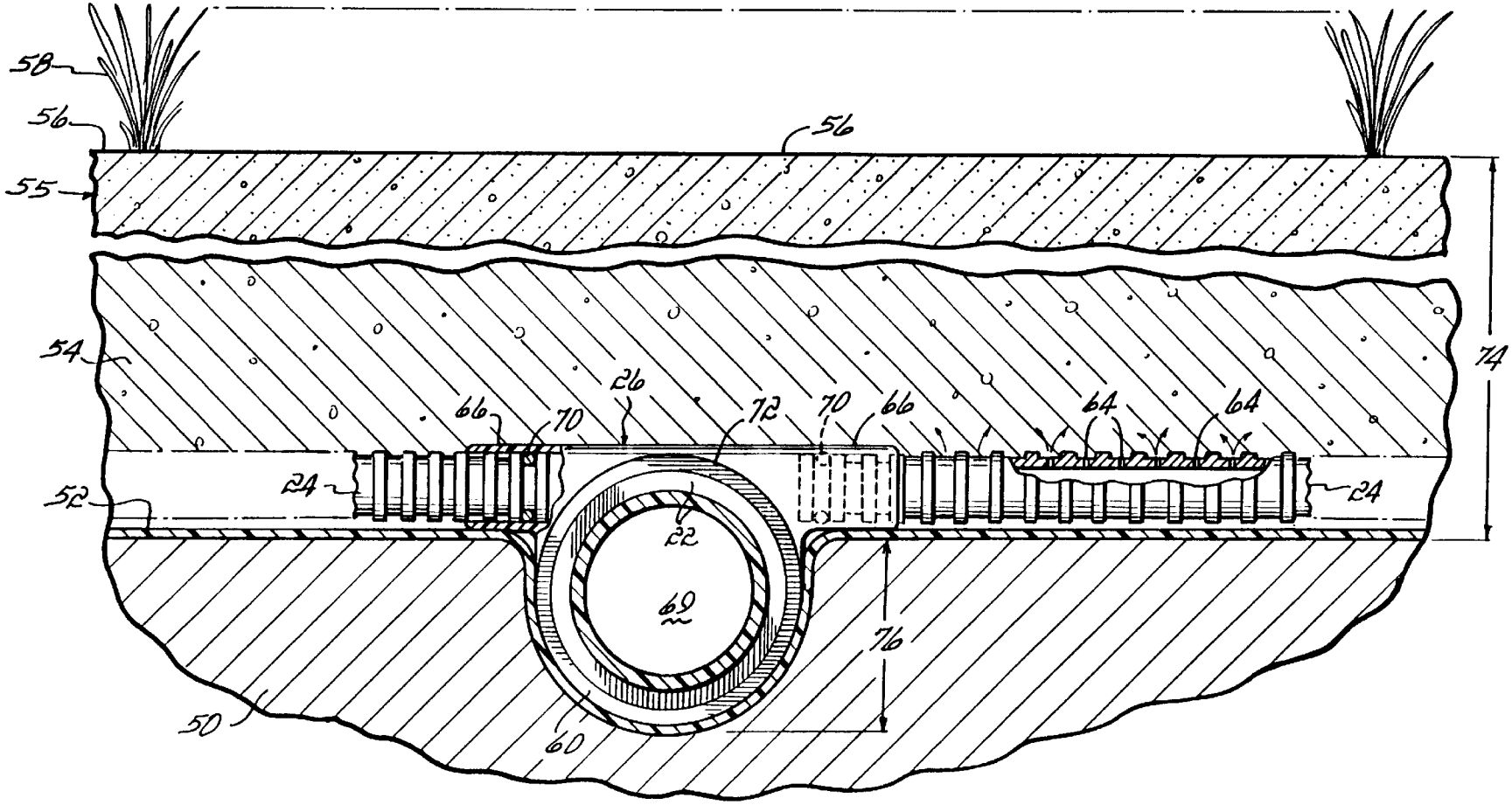
FIG. 3 is a cross-sectional view taken along lines 3—3 of FIG. 2.

FIG. 3 shows further advantages of the drainage network 14 of this inventive system 10, particularly the advantages which result from use of the couplings 26. More specifically, FIG. 3 shows that the vertical dimension between the membrane 52 and the athletic surface 56, represented by reference numeral 74, is minimal. According to applicant's present specifications, this vertical dimension should preferably be about 12 inches, which represents a reduction from the previously required 14 inch, or more, vertical profile of other prior art controlled water table or vacuum-enhanced drainage systems. Due to the relatively high cost of the fill layer 54, which is usually sand, this two-inch reduction of the vertical profile represents a cost savings on the order of about $25,000 U.S. per field. Additionally, it may be possible to further reduce the vertical profile 74 to a dimension as low as ten inches, or maybe even lower.

Reference numeral 76 represents the depth of the depressions 60 which must be excavated in the compacted subsoil 50. Preferably, this dimension is about 150 mm (5.850 inches). As noted above, the system 10 results in lower installation costs because it requires excavation of only five (for an American football field) longitudinal depressions 60 of this shape along the length of the field 12. This represents numerous practical advantages over prior water table controlled or vacuum-enhanced drainage systems. Namely, it is much easier to excavate one set of parallel rows at one depth and without any intersections, than multiple sets of rows at multiple depths and with multiple intersections. These multiple excavations also increase the difficulties in maintaining a desired degree of flatness in the subsoil 50 along the entire lengths of the excavated depressions and also the unexcavated portions, a flatness which is necessary to provide a consistent flow line for the system.

In addition to excavating only along parallel lengths, the depths of the depressions 60 are relatively shallow, compared to prior water table controlled or enhanced vacuum drainage systems. This minimizes the difficulties in achieving a relatively flat subsoil base 50 and a level, gravity drainable flow network 14. As noted above, once excavation has been completed, it is much easier to conform a membrane 52 within a plurality of parallel depressions 60 at one level, than a plurality of perpendicular and intersecting depressions at multiple levels. For the most part, the present invention avoids the use of any drains or portions of the network 14 below the barrier 52. In some cases, due to field shapes or sizes, it may be necessary to locate the tank 32 along the longer edge of the field 12, thereby requiring routing of the main pipeline 16 under the field 12 along the side edge, so that each of the pipe rows 22 connects to the main pipeline 16 via a downward connection through the barrier 52. In short, the particular design of the couplings 26 minimizes the vertical profile of the drainage network 14, and the overall system 10. As a result, this coupling 26 significantly reduces installation costs for the system 10.

The couplings 26 are preferably formed by injection molding of high density polyethylene, so that the upper section walls 66 and the lower section walls 68 are integrally formed. The coupling 26 could also be formed by rotation molding. Presently, it is preferable to form the couplings 26 in a single molding process, but the invention also contemplates the molding of separate pieces and then bonding them together as a single piece. As a result of the present injection molding step for forming the couplings 26, plastic material is left inside the coupling 26 at both ends of both flow passages 67 and 69, and this plastic material must be cut away to access the hollow interior of the coupling 26. For couplings 26 used near the center, or away from the edge of the field 12, this removal of obstructing plastic is performed at both ends of both flow passages of the coupling 26. For the couplings 26 used along the edges of the athletic field 12, i.e. along the outer two pipe rows 22, this flow blocking material is left in place along one side of passage 67. This closes off the network 14 at that point to assure a fluid tight, or closed, system around the outer perimeter of the athletic field 12.

Figure 4:
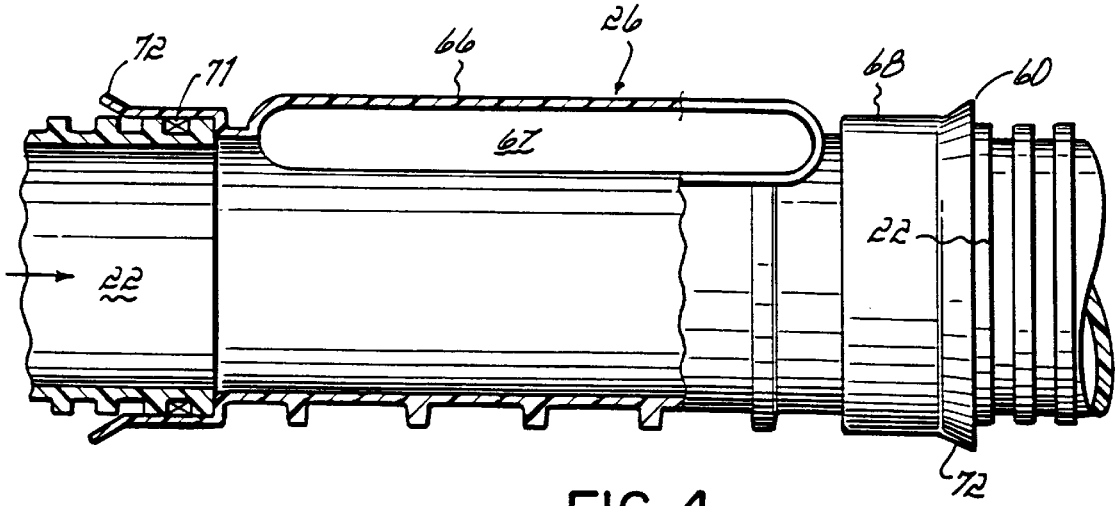
FIG. 4 is a cross-sectional view taken along lines 4—4 of FIG. 2.

FIG. 4 also shows the couplings 26 in cross-sectional view, as viewed in longitudinal cross-section with respect to a pipe row 22, or transverse with respect to the conduit row 24. This view shows the upper flow passage 67, similar to the manner in which FIG. 3 shows the lower flow passage 69.

FIGS. 3A and 8 show an alternative embodiment of the coupling 26 of this invention. More specifically, FIGS. 3A and 8 show a coupling 26 reinforced by a reinforcement plate 26*a,* which secures to the coupling by a plurality, preferably eight, of stainless steel self-tapping screws 26*b*. The reinforcement plates 26*a* provide additional rigidity for the drainage network 14 (FIG. 7) at its weakest locations, above the couplings 26. The reinforcement plate 26*a* has preferable dimensions of 12"×18"×⅜", with the long dimension oriented parallel to the respective conduit row 24, and the plate 26*a* is preferably made of high density polyethylene. If desired, one or more elongated ribs 26*c* may be secured to the top surface of the reinforcement plate 26*a* by additional screws 26*d,* for additional strength. The additional rigidity provided by the reinforcement plate 26*a* is typically not necessary for normal operation, when a group of athletes is performing on the field 12. Rather, the reinforcement plate 26*a* provides assurance against deformation when heavy loads such as fork lifts or trucks drive across the field 12, as is sometimes necessitated by use of the field 12 for nonsporting events.

In addition to the reinforcement plate 26*a,* an elastomeric band 26*e,* preferably 3" width, 1/10" thick, and 6" diameter, may be used to surround the adjacent outer edges of the coupling 26 and the conduit 24, thereby to further secure the fluid seal between the coupling 26 and the conduit row 24. A clamp 26*g* may be secured over the top of the band 26*e,* to more firmly secure the mechanical interconnection between the coupling 26 and the conduit row 24. At present, applicant believes that the best way to join the couplings 26 to the conduit rows 24 would be to mold the coupling 26 to include conduit extensions 26*f* to extend outwardly toward the conduit rows 24, thereby to facilitate the forming of an end to end or butt-joint connection therewith. With this type of connection, the elastomeric band 26*e* would preferably span the outer circumference of the coupling extension 26*f* and the conduit 24 to provide a fluid seal at this joint. A top clamp 26*g* having a cross-sectional shape complementary to the top of the conduit 24 would then be placed over the band 26*e* and then secured, as by stainless steel self-tapping screws 26*h,* to the coupling extension 26*f* and the conduit row 24, thereby to mechanically secure the coupling 26 to the conduit row 24. FIG. 3A shows an example of a butt-joint of this type, except that in FIG. 3A the extension 26*f* is simply an additional section of typical conduit 24, as would be obtained in retrofitting a previously installed coupling 26 not equipped with the reinforcement plate 26*a*.

The invention further contemplates integrally molding the couplings 26 with one or more of these components in order to minimize the total number of components and the number of connecting steps required at each intersection. In one manner of molding, the ribbed reinforcement plate 26*a* may be molded as a single piece and then heat welded to the coupling 26. If the coupling 26 has extensions 26*f* which extend beyond the plate 26*a,* the plate 26*a* may also be integrally molded with the upper clamp 26*g* described above. In effect, this would move the joint shown at the right side of FIG. 3A closer to the pipe 22, and it would eliminate one of the two couplings shown in FIG. 3A. Other variations would also be suitable, with the primary objectives at the intersection of the pipe rows 22 and the coupling rows 24 being to provide a fluid tight seal, to prevent ingress or egress of the fill material, and to provide sufficient structural rigidity to prevent deformation problems for the network 14, preferably in a manner which also minimizes components and connection steps made during installation.

Figure 5:
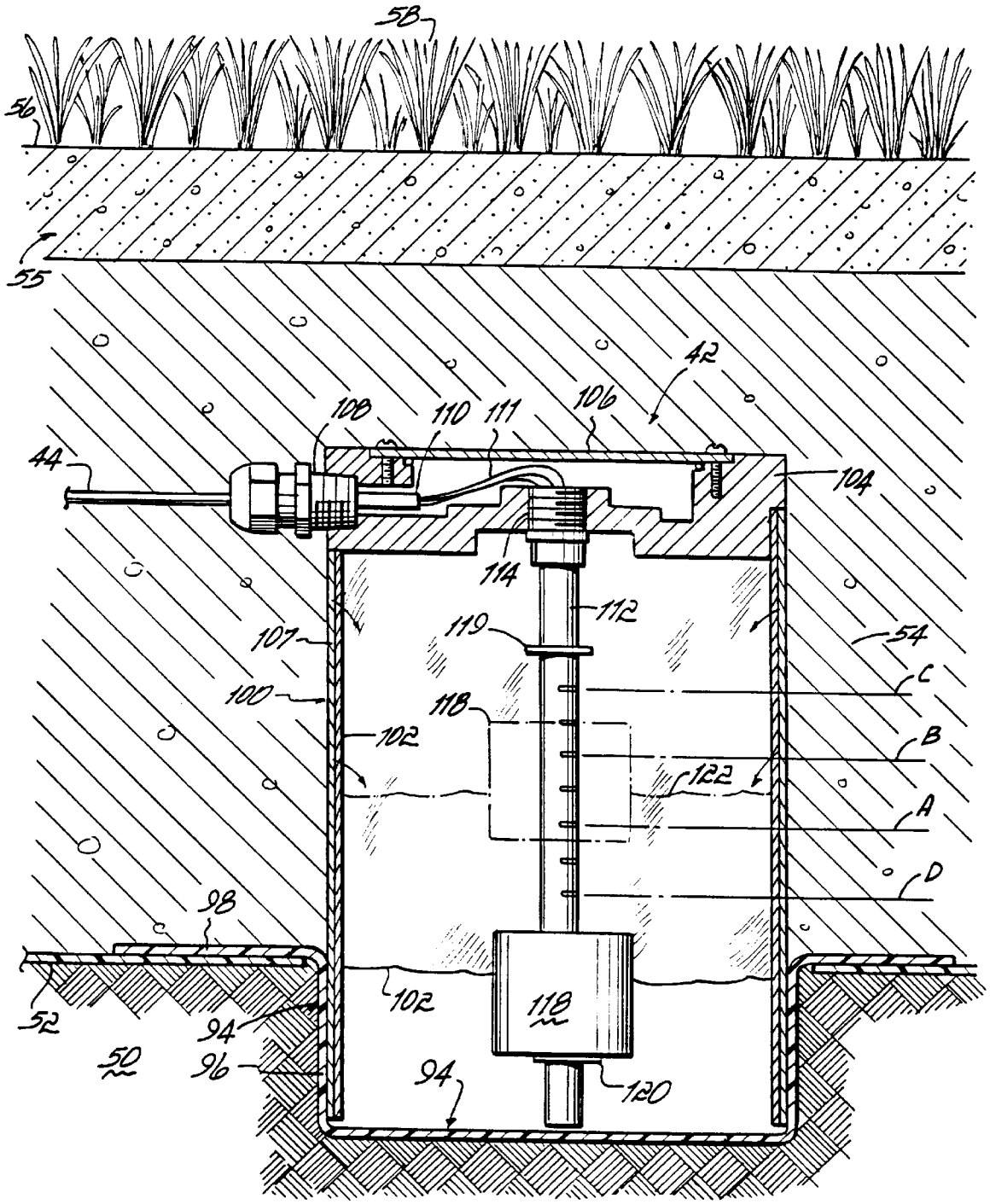
FIG. 5 is a cross-sectional view taken along lines 5—5 of FIG. 1, showing a sensor used in accordance with an automated version of the invention.

FIG. 5 shows a cross-sectional view of a water level sensor 42 constructed in accordance with a preferred embodiment of the invention. As noted above, a plurality of such sensors 42 are buried within the fill layer 54 to measure the level of water above the membrane 52, for the automated version of the system 10, to initiate vacuum-assisted drainage, subirrigation or overhead irrigation. FIG. 1 shows four sensors 42, the preferable number for a typical football field. Each of the sensors 42 includes a cylindrically-shaped housing with water permeable sidewalls, and a mechanical float located therein.

More specifically, as shown in FIG. 5, the sensor 42 includes a bottom plate 94 which is preferably of circular shape. The bottom plate 94 has a central recess defined by recessed cylindrical walls 96, and an upper flange 98. The upper flange 98 rests on the membrane 52. The sensor 42 is cylindrical in shape, but the shape is derived particularly from a cylindrical sidewall 100, which includes an outer screen 101 and an inner screen 102. The outer screen 101 has openings with maximum sizes of about 3.2 mm (0.125 inches), and the inner screen is preferably an 80 mesh screen with openings of about 0.18 mm (0.007 inches), respectively, to allow passage of water therethrough but to prevent ingress of sand or other materials into the sensor 42. As will be appreciated, in some circumstances, the sidewall 100 may be comprised of only the 80 mesh screen 102. The sizing of the openings may be varied depending on the composition of the fill layer 54.

The sensor 42 includes a removable top 104 which fits onto and within the sidewalls 100. The removable top 104 further includes a separate access lid 106 held thereto via threaded screws 107. The lid 106 covers a volume within the cap 104 that forms an electrical junction box. A threaded connector 108 mounts to the side of the removable top, and the threaded connector 108 terminates in an inner sleeve 110 through which electrical leads 111 extend into the junction box. The electrical leads 111 are connected to a sensing rod 112 which has an upper end 114 thereof threaded into the removable top 104. As will be appreciated, the junction box portion of the sensor 42 may be designed as a separate unit. The sensing rod 112 preferably includes spaced sensing gradations 116 which are about 6.4 mm (0.25 inches) apart, although a spacing of about every 12.8 mm (0.5 inches) would also be suitable. Above and below the gradations 116, the sensing rod 112 includes an upper stop 119 and a lower stop 120 which limit upward and downward movement, respectively, of a float 118 mounted on the sensing rod 112. The float 118 is annular in shape, and it moves vertically along the sensing rod 112 according to the vertical level of water within the sensor 42.

Via the gradations 116, the sensing rod 112 measures the vertical position of the float 118, and the sensed vertical position is converted to an electrical signal. More specifically, at each gradation 116, the sensing post 112 includes a presence sensor such as a switch which is mechanically or electromagnetically actuated by the float 118, to detect water level above the barrier 52. If sensing is done electromagnetically, the float 118 must have a magnetically permeable portion, such as a small piece of metal mounted thereon. Regardless of the specific details of construction used to sense the water level, the device should sense water level in increments of preferably 6.4 mm (0.25 inches), or at least increments of 12.8 mm (0.5 inches).

In FIG. 5 the sensor 42 is shown recessed within the compacted subsoil 50. This is necessary because of the particular configuration of the sidewalls 100 and the shape and dimension of the sensing rod 112 and the mechanical float 118. The sizing of these components is such that the float 118 does not vertically raise from its bottommost rest position on stop 120 until the water level, designated by reference numeral 122, raises above the vertical level of the membrane 52 outside of the sensor 42. In other words, with this particular sensor 42, the shape and dimensions of the float 118 require that it be recessed slightly within the compacted subsoil 50.

To recess the sensor 42, the membrane 52 is cut at the desired position, and the radially surrounding flange 98 is sealed to the membrane 52 around the outside of the sensor 42 to maintain a liquid barrier between the fill layer 54 and the compacted subsoil 50. However, if desired, the sensor 42 may be configured in such a manner that it does not require recessing within the compacted subsoil 50. This could be done simply by changing the dimensions of the float 118 with respect to the sensing rod 112, or even by taking readings from the bottommost position of such a mechanical float 118.

Figure 6:
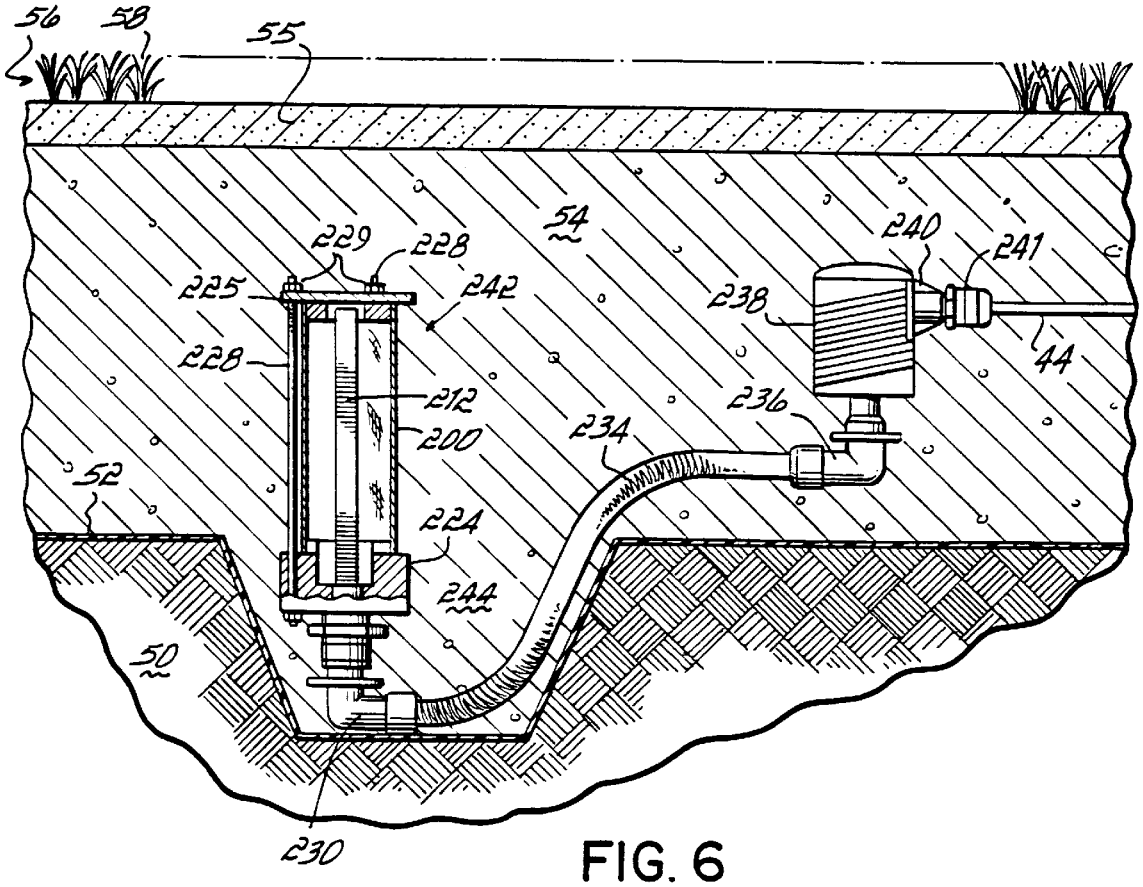
FIG. 6 is a cross-sectional view, similar to FIG. 5, which shows another version of a sensor for operation of the system in automatic mode.

As a further alternative, it would also be possible to modify the sensing rod 112 so that the water level is measured without the use of a float 118. For instance, as shown in FIG. 6, the water level 122 may be measured by a sensor 242 with an elongated probe 212 having an outer metal surface which acts as one "plate" of a parallel plate capacitor. This capacitive probe 211 is a shortened version, i.e. about 225 mm (8.875 inches), of other commercially available, elongated capacitive probes manufactured and sold under the trademark "SYMPROBE" by a company called Flowline, located in Seal Beach, Calif. Because of the electrical conductivity of water, the total surface area of the probe 212 in contact with the water, i.e. the surface of the probe 212 located below the water level 122, will affect the capacitive reading of the probe 212; and this capacitance will proportionally affect the electrical current flowing in the sensor 242. By calibrating the sensor 242, measured water levels can be correlated to provide a signal corresponding directly to measured capacitances, and hence the amount of electrical current can be correlated to provide a signal corresponding directly to the measured water level 122.

The sensor 242 includes spaced first and second caps, 224 and 225, respectively, which are secured together by a plurality of elongated clamping screws 228 held by nuts 229. This structure secures a cylindrical housing 200 which is similar in construction to housing 100 shown in FIG. 5. Housing 200 also has inner and outer screens but a lower diameter, i.e. about 89 mm (3.5 inches). The capacitative probe 212 is located in the housing 200, oriented vertically, and is supported vertically by the first cap 224. The first cap 225 and the fitting 230 are fitted within a recess 244 in the subsoil 50, with the membrane 52 conforming to the recess 294. The depth of recess 244 corresponds to the vertical dimension of the fitting 230 and first cap 224. A flexible hose 234 interconnects fitting 230 to a remote fitting 236, which connects to an enclosed cylindrical housing 238 which encases the electronics associated with the sensor. The housing 238 includes a threaded extension 240 to which a hexagonal nut 241 connects, to secure the cable 44 thereto. The components of housing 238 are commercially available from Flowline, and sold in combination with the probe 212. Although the sensor 242 is shown in one orientation in FIG. 6, as will be appreciated the sensor 242 may also be mounted in an inverted orientation.

With this capacitance probe 212, current flow output from the sensor 242 fluctuates within the range of between 4 and 20 milliamps. Referring to FIG. 5, the controller 46 is used to correlate signal magnitudes from the sensor 42 to predetermined water levels 122 (reference levels C and D), which correspond to the need to initiate vacuum-assisted drainage and the need to irrigate. Between these two extremes, at least two additional settings are determined for initiating gravity drainage (reference level B) and for simply maintaining a predetermined optimum water level 122 (reference level A), where no change to the system 10 is initiated.

Whichever manner of water measurement is chosen, it is preferred that the presence of water be measured directly via measurement of the physical presence the water with a float or other device, within the water permeable housing buried in the fill layer 54. This is due primarily to the lack of reliability of prior soil or fill layer moisture sensors used for automatic control of vacuum-enhanced drainage, subirrigation, or overhead irrigation in prior drainage systems for athletic fields.

Previously, sensors for such systems relied upon the electrical conductivity of the fill layer located below the natural turf surface 56. However, readings of this nature may be affected not only by the presence of moisture or water but, also by temperature, season, and perhaps mostly by the composition and quantity of fertilizer on and below a typical natural turf athletic field, because many fertilizers include electrically conductive elements or materials. Because the distribution of such fertilizer is never entirely even over the entire surface, the "fertilizer effect" may be different at different locations of the field. This could result in different electrical conductivity readings from sensors placed in different positions of a field, despite a uniformity in water content throughout the field. In sum, for various reasons, applicant has learned that for many prior automatic drainage systems the moisture readings taken have not accurately reflected the moisture level of the field.

In short, the system 10 of this invention, if adapted for vacuum-enhanced drainage or subirrigation in an automatic mode, contemplates the use of a plurality of sensors 42 which, through any one of a number of different methods, measure the physical level of the water above the barrier 52. This approach: 1) simplifies the components involved with sensing the water content within the field 12; 2) simplifies automated control of vacuum-enhanced drainage and/or irrigation for such a system 10; 3) enhances reliability; and 4) allows easy integration and coordination of other drainage and irrigation features. Because the sensors are located directly on the membrane 56, which forms the major portion of the bottom surface of the entire system, there is no uncertainty related to deciding where is the best location for the sensors. Locating the sensors directly on the membrane 52 also facilitates simple and accurate positioning of all the sensors in the same horizontal plane.

To install the system 10, the subsoil 50 is compacted at a desired horizontal level within a predetermined tolerance range, and a plurality of excavated depression 60 are formed along the length of the field 12. A membrane 50 is then placed on the compacted subsoil 50, with most of the membrane 52 residing on flat, parallel undepressed portions of the compacted subsoil 50, but with some of the membrane 52 extending downwardly into the parallel depressions 60, to conform to the topography of the excavated subsoil 50. Because the membrane 52 is usually purchased in rolls about 22.5 feet wide, the seams are heat welded together after unrolling at the site, to assure water tight seals between adjacent rolls.

A plurality of pipe rows 22 are laid out along the depression 60, above the membrane 52. At each of the intersections of the plurality of parallel longitudinal pipe rows 22 and the plurality of parallel conduit rows 24, one of the couplings 26 is placed. Preferably, in each pipe row 22 and in each conduit row 24, a single piece extends between every two intersections. For the conduit rows 24, the edgedrain 24 described in the above-identified Goddard patent is typically sold and shipped in rolls, so that it may be simply unrolled into the desired positions, and cut at the intersections at the desired lengths.

At each intersection, the ends of the pipe row 22 are connected to the ends of the lower section walls 68 of the coupling 26 to connect the coupling 26 in alignment therewith. Thereafter, the ends of the conduit row 24 are connected to the upper wall sections 66 of the coupling 26. For both connections, interconnection is made simply by first locating the internal gasket in place, and then inserting the pipe or conduit into the coupling 26, to provide a fluid fight interference fit.

As indicated previously, in interconnecting the conduit rows 24 with the couplings 26, it may be desirable to add circumferential gaskets at the junctions of the conduit ends and the ends of the upper wall sections 66 of the couplings 26, to assure fluid tight connection. Regardless, all of the connections made to complete the drainage network 14 may be done manually, without requiring tools.

Thus, the grading and excavating of the subsoil 50, the placement of the membrane 52 and the installation of the drainage network 14 have been greatly simplified, resulting in a reduction in costs. After these initial steps, the fill layer 54 is filled in over the membrane 52, to bury the drainage network 14. The main pipeline 16 connects in parallel to each of the pipe rows 22 along one end of the field 12. The main pipeline 16 is constructed so as to provide access at one end thereof to a water supply source 18, and routing at another end thereof 20 to a storm drain. This latter step includes installation of a wet pit 17 along the flow path to the storm drain 20, along with the valve 21 and the vertically adjustable upstack 19.

On top of the fill layer 54, the surface 56 for an athletic field 12 is formed by supplying the additional rooting layer 55 for sustaining growth of natural turf 58. These steps result in the basic system 10 which provides the primary advantages of this invention. With this basic system 10, the water level 25 may be manually controlled to some extent. With the valve 21 closed, gravity flow drainage occurs when the water level 122 exceeds the distance 25 of the upstack 19 above the barrier 52. The field 12 may also be irrigated by selecting the level of the upstack 19 and supplying water to the main pipeline 16, again with valve 21 closed. In this manner, water flows directly into the network 14 and onto the barrier 52 for upward absorption to the turf 58.

Additionally, the feature of vacuum-enhanced drainage may be added to the system 10. This is done by adding the vacuum/drainage line 28, the second valve 30, the buried collection tank 32, the air line 34 and the vacuum pump 36, preferably remote from the vacuum tank 32 and located above level of the field 12. Also, the valve 23 is added to the main pipeline 16, to isolate the drain 20. As described previously, these components cooperatively interact to provide vacuum-enhanced drainage for the system 10. These components may be added during initial installation of the system 10, but the system 10 is also configured so that these components may be added relatively easily at a later date, to provide this feature as an update or as an enhancement. If added initially, all drainage may occur through the tank 32, but this is not preferred, because it would result in the need to pump all drained water from the tank 32. Thus, the dual, parallel gravity/vacuum drainage capability is preferred.

As a further enhancement, either at initial installation or during updating, the system 10 may also include the components for automatically controlling vacuum-enhanced drainage, or even irrigation, via subirrigation or overhead irrigation. To do this, the plurality of sensors 42 are buried within the field 12, such that each sensor 42 measures the level of the water above the membrane 52 in that particular section of the field 12. The sensed water level signals are converted to electrical signals and conveyed to the controller 46 via buried electrical lines 44. The controller 46 is programmably controlled to preferably average the signals from the different sensors 42 to provide a water level value representing an average water level over the whole field 12. The controller 46 is further programmed to integrate and coordinate operation of the other components to provide vacuum-enhanced drainage, gravity drainage, subirrigation or overhead irrigation, if desired, depending upon the manner in which the controller 46 is programmed and the water level sensed by the sensors 42. The controller 46 may also be configured to conserve water, by maintaining valves 23 and 30 in a closed position to keep water in the system.

Ideally, with automatic control via use of the controller 46 and the sensed water level signals from the sensors 42, the system 10 enables an optimum water level 122 above the membrane 52 to be maintained. For instance, as shown in FIG. 5, reference level A represents an optimum water level 122. If rain begins, and the water level 122 reaches reference level B, the controller 46 opens valve 23 to allow gravity drainage of the network 14. Valve 30 is closed also, if necessary. This condition continues until the water level 122 recedes back to level A. However, if the water level 122 continues to rise, to a maximum level, indicated by reference level C, the controller 46 closes valve 23, opens valve 30 and activates vacuum 36 to begin vacuum-assisted drainage of the system 10. The vacuum assisted drainage continues until the water level 122 recedes back to level B, at which time the controller 46 signals the necessary components to switch back to gravity drainage.

If the water level 122 goes back up to level C, the controller 46 again initiates vacuum assisted drainage. On the other hand, if the water level 122 falls back to the maintenance level A, the controller 46 closes valves 23 to discontinue gravity drainage.

If the water level 122 recedes from the desired level A, to a predetermined low level designated by letter D, the controller 46 activates irrigation, either via subirrigation subsystem 246 (FIG. 1) by closing valves 23 and 30 and opening valve 248 which is connected to a source of pressurized water 250 or by activating subsurface overhead sprinklers, (not shown) as is known in the industry.

With the sensor 242 of FIG. 6, there is another advantage, which enables the system to be adapted for different rainfall amounts in different geographical regions, or even different seasons of the year at one location. Namely, after the sensor is calibrated with respect to the water levels represented by its signal outputs, the settings for water levels A–D may be automatically changed, or programmed, to fit the desired set of circumstances. This can be done simply by recalibrating the sensor output signal levels which correspond to water levels A–D. Even with the automated version of the system 10, it may be preferable during the off-season, for cost reasons, to simply disable the controller 46 to gravity drain the network 14 via the upstack 19.

While several preferred embodiments of the inventive method have been described, it is to be understood that the invention is not limited thereby and that in light of the present disclosure, various other alternative embodiments will be apparent to a person skilled in the art. For instance, the drain network 14 could be oriented such that the pipe rows 22 extend transverse to the field 12, and so that the conduit rows 24 extend longitudinally. In some cases, the tank 32 may be located somewhere other than along one of the longitudinal ends of the field 12, depending on spacing and dimensions in the stadium with respect to adjacent stands. Also, the rolls which are heat welded to form the membrane 52 may be oriented either perpendicular to the depressions 60 during unrolling, as described previously, or parallel thereto.

Further, referring to FIG. 1, the controller 46 may be implemented by a programmable controller that has the capability of connecting by modems and a telephone line or other communication link 254 to a computer 254 located at a geographically remote location. Therefore, the controller 46 may be accessed from the remote computer 254 to determine the operating state of any of the sensors 42 or the valves 21, 23, 30, 48 or other components, for example, pumps, within the subsystems, 15, 27 246. Further, the operating state of those valves, pumps and other components may be changed from the remote computer 254. Therefore, water levels within the fill layer 54 can be monitored at any time from any location, and the appropriate action taken to maintain the desired moisture level in the fill layer. In addition, the predetermined water levels at which various actions are automatically taken can be varied from the remote computer. Further, components within the system can be checked from the remote location to fund components providing a faulty response to operation, and instructions for fixing or replacing those components can then be provided.

Figure 7:
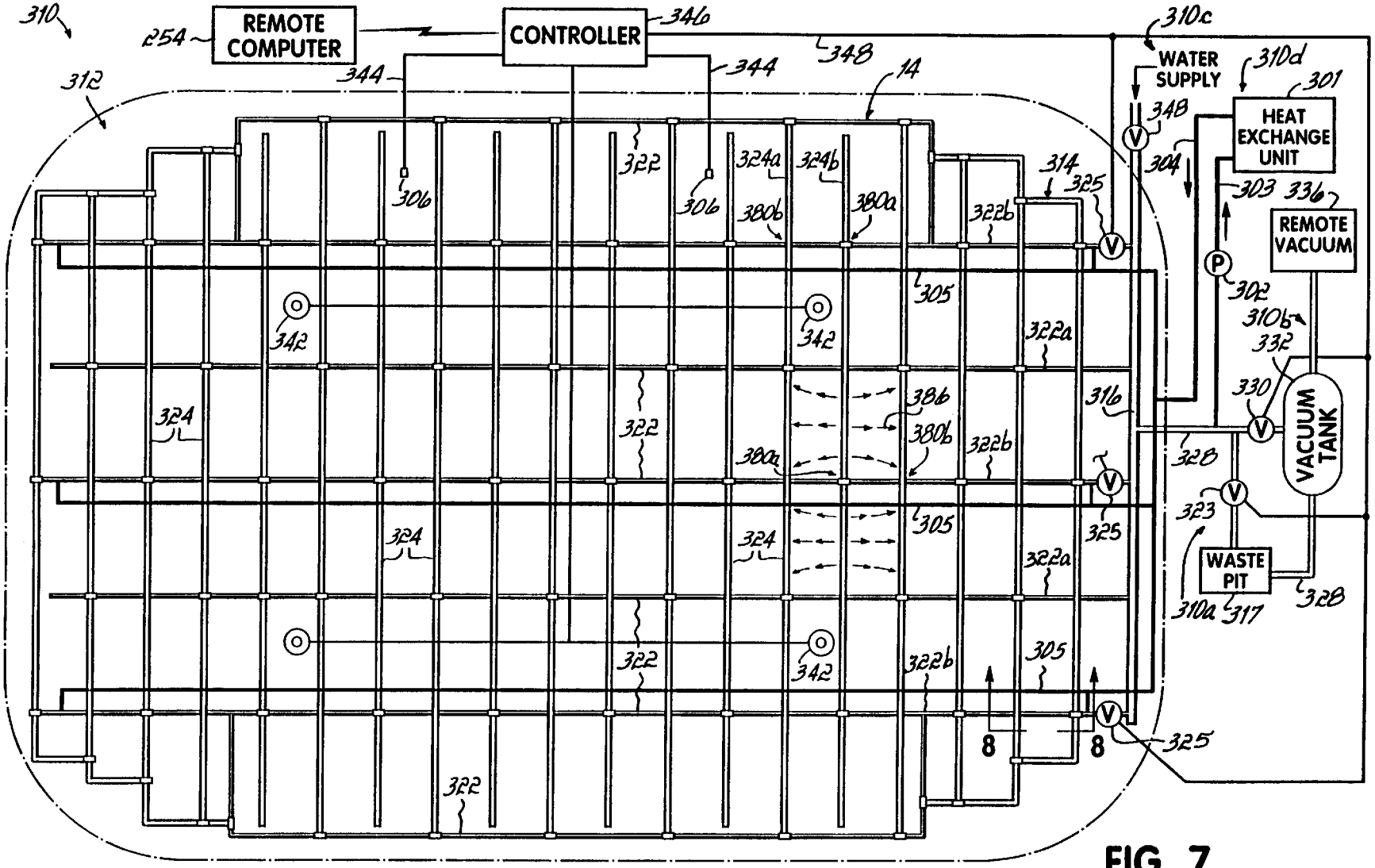
FIG. 7 is a schematic plan view, similar to FIG. 1, which illustrates an athletic field drainage, irrigation and heating system in accordance with another preferred embodiment of the invention.

FIG. 7 is a schematic view, similar to FIG. 1 which shows a system 310 constructed in accordance with another preferred embodiment of the invention, so that the field 312 may be gravity drained, drained by vacuum enhancement, irrigated (or subirrigated) or heated via the cooperation of the gravity drainage subsystem 310*a,* a vacuum-enhanced drainage subsystem 310*b,* a subirrigation subsystem 310*c* and a heating subsystem 310*d.* More importantly, the gravity drainage subsystem 310*a,* the vacuum-enhanced drainage subsystem 310*b* and the heating subsystem 310*d* (and subirrigation subsystem 310*c* if desired) all use the same drainage network 314. With reference to FIG. 7, components described previously with respect to FIGS. 1–5 have corresponding 300 series numbers, to facilitate understanding of the operation of the system 310 and to simplify this description.

According to the system 310 shown in FIG. 7, plurality of pipe rows 322 extend along the length of the field 310, while a plurality of conduit rows 324 extend transversely thereto. The spacing of the pipe rows 322 and conduit rows 324 depends on the dimensions of the field 310. Preferably, the conduit rows 322 are spaced on 8' centers. Also, FIG. 7 is only exemplary of this system 310 and therefore only shows five pipe rows 322. For a typical soccer field, the width of the field would probably dictate that nine pipe rows 322 be used. Along the edges of the field 312, the ends of the coupling rows 324 may be joined by forming mitred connections and routing the rows 324 together.

Unlike the system 10 shown in FIG. 1, with the system 310 shown in FIG. 7 not all of the pipe rows 322 and conduit rows 324 operate in the same manner. Rather, a first group of the pipe rows, preferably two but more than two if desired or necessary, designated by reference numeral 322*a,* are dedicated to fluid drainage at all times. In this description, these pipe rows 322*a* are referred to as "drain only" pipe rows 322*a.* A second group of pipe rows, referred to by reference numeral 322*b,* are used for drainage (either gravity drainage or vacuum-enhanced drainage) or supplying heated water to the network 314. To enable these "dual purpose" pipe rows 322*b* to be used for these two distinct functions, these pipe rows 322*b* have isolation valves 325 located adjacent the main drainage line 316, so that each of these dual purpose pipe rows 322*b* may be selectively isolated therefrom. Preferably, every other row 322 is a dual purpose pipe row 322*b,* while the others are drain only pipe rows 322*a.*

The water heating components of the heating subsystem 310*d* connect to the main line 316, in parallel with the gravity drainage subsystem 310*a* and the vacuum-enhanced drainage subsystem 310*b.* More specifically, the heating subsystem 310*d* components include a heat exchanger 301 and a recirculation pump 302 which connect in series to the main line 316 via an inlet line 303 and an outlet line 304. The outlet line 304 operatively connects the heat exchanger 301 and the pump 302 to the drainage network 314, bypassing the main line 316. More specifically, the outlet line 304 connects via dedicated heating lines 305 to opposite ends of each of the dual purpose pipe rows 322*b*. The inlet line 303 and outlet line 304 may remain water-filled and in fluid communication with the main line 316 and the network 314 even when the system is not operating in heat mode. The heat exchanger 301 and the recirculation pump 302 are operatively connected to the controller 346, which also may be operatively connected to a remote computer 254. The system 310 includes water level sensors 342 as described previously, and the water level sensors 342 operatively connect to the controller 346 via electrical lines 344. System 310 also includes a membrane 352 residing over a compacted subsoil 350, with the pipe rows 322 residing in depressions formed in the compacted subsoil 350, and a fill layer 354 above the membrane 352 (FIG. 8).

In addition to the water level sensors 342, two or more temperature sensors or probes 306 are located within the fill layer 354. These temperature probes 306 are preferably analog readout temperature probes, and may be similar to those currently used in conjunction with other types of athletic field heating systems. The probes 306 operatively connect to the controller 346, so that upon detection of a predetermined low temperature, the temperature probes 306 generate signals to the controller 346 which result in the controller 346 actuating the heating subsystem 310*d*. More specifically, this actuation of the heating subsystem 310*d* involves: 1) closing of the gravity drainage subsystem by closing valve 323; 2) closing of the vacuum-enhanced drainage subsystem 310*b* by closing valve 330; 3) closing of the isolation valves 325 to isolate the dual purpose pipe rows 322*b* from the main drainage line 316, to place these rows 322*b* in heating mode: and 4) actuating the heat exchanger 301 and the recirculation pump 302. This causes the pump 302 to pump heated water from the heat exchanger 301, through the outlet line 304, through the dedicated heating lines 305 and into the "dual purpose" pipe rows 322*b*.

In the network 314, at every other intersection, referred to as a first group of intersections and designated by reference numeral 380*a*, each respective pipe row 322 is connected to a respective conduit row 324 via a coupling 326. However, at the other, "second" group of intersections, designated by reference numeral 380*b*, the conduit row 324 does not connect to the corresponding pipe row 322. If desired, a slight depression may be formed in the pipe row 322 to eliminate any "hump" which would otherwise be caused by the overlaying conduit row 324.

With the network 314 configured in this manner, the heated water supplied to the dual purpose pipe rows 322*b* moves into a first plurality of conduit rows 324*b* at a "water supply" group of the first intersections 380*a*, then moves along the conduit rows 324*b* while percolating outwardly therefrom via the apertures 364, eventually into the fill layer 354. This upward movement of heated water into the fill layer 354 occurs throughout the network 314 because the first plurality of conduit rows 324*b* alternates along the length of the field 312. At the same time, because the pipe rows 322*a* remain connected to the main line 316, cooler water drains by gravity from the fill layer 354, into a second plurality of the conduit rows 324*b* and eventually to the pipe rows 322*a* at a "water drainage" group of the first intersections 380. Again, this draining of water from the fill layer 354 into the main pipe 316 occurs throughout the network 314 (FIG. 8). Generally, because of the manner of interconnection of pipe rows 322 and the conduit rows 324, every other conduit row 324 will become primarily a heated water supply line or a cooler water return line. More specifically, the conduit rows 324*b* which intersect with dual purpose lines 322*b* at the "water supply" group of intersections 380*a* will supply heated water, while the alternate conduit rows 324*a* will receive cooler water and drain it to the pipe rows 322*a* at the "water drainage" group of intersections 380*a*. This is best shown in FIG. 8, where directional arrows 386 represent water flow generally below the normal operating level A, and directional arrows 384 represent heat movement above level A.

Thus, the heating subsystem 310*d* supplies heated water to the fill layer 354 and receives cooled water from fill layer 354 so that the water level above the membrane 352 remains substantially the same, with the drainage network 314 submerged. In this sense, the heating subsystem 310*d* operates as a closed loop. Yet, the loop is not closed in that water moves out of and back into the drainage network 314 during heating of the fill layer 354.

By using the drainage network 314 to both drain and heat the field 312, this invention eliminates the need to install and maintain separate underground systems for heating and draining. Just in hardware alone, this invention represents a cost savings. Moreover, by flowing heated water into fill layer 354 to heat the field 312 while removing cooler water from the fill layer 354, this system 310 is more energy efficient than prior art systems for heating athletic fields. The primary energy consuming components are the heat exchanger 301 and the circulation pump 302, but the amount of energy consumed by these components is relatively small compared to electric cable heaters or separate fluid flow heat radiation systems. This reduction in energy consumption is attributable primarily to the fact that the water needs only to be heated moderately, i.e. to about 65° F., to prevent the field surface 356 and root zone from freezing, and the pump 302 needs only to be operated at a sufficient rate that the relatively "cooler" water is returned to the heat exchanger 301 at a moderately cool temperature, but well above freezing, i.e. at about 55° F. Thus, the heat exchanger 301 need only elevate the water temperature by a relatively moderate amount, i.e. about 10° F., and the pump 302 need only be operated in a manner which provides a pumping rate sufficient to maintain this moderate temperature differential. The specific flow rate will depend upon the total volume of water above the membrane 352 and within the rest of the drainage and piping components. Accordingly, for any given field 312 this flow rate may vary, due to volume differences. Applicant intends to determine this flow rate for each particular field via computer modelling, but a trial and error approach would also work. Moreover, experience learned from operating a system 310 in a particular geographic area will also undoubtedly play a role in determining optimum operational parameters.

If desired, in addition to the temperature probes 306 embedded in the fill layer 354, air temperature sensors (not shown) may also be employed, since air temperature lowers prior to lowering of the ground temperature. With early sensing of lowered air temperature, the heating subsystem 310*d* of this invention may be started up so that the root zone of the field 312 will be heated sufficiently, so that the ground temperature never goes below a predetermined value, such as about 50° F. This manner of operating the heating subsystem 310*d* is beneficial because it is more energy efficient to continuously operate the heating subsystem 310*d* to maintain the roots in a temperature range well above freezing, than it is to let the field initially freeze, at or below 32° F., and then having to elevate the field temperature to thaw it. Stated another way, it is more energy efficient to run this heating subsystem continuously to prevent the root zone from freezing, compared to allowing the root zone to freeze and then thawing it. In effect, this heating subsystem 310*d* operates as a giant heat sink, with the water therein elevated to a temperature sufficient to prevent the root zone 355 and the turf 358 from freezing, and the water flowed therethrough is pumped at a rate sufficient to maintain the temperature drop across the heat exchanger 310 at a predetermined moderate range, say about 10° F.

Both before and while the heating subsystem is operating, it is preferable that the controller 346 continue to monitor the water level above the membrane 352. This allows corrective action to be taken if the water level goes too low, since it is important that the network 314 remain submerged during heating. If for some reason the water level is below the normal level A, the controller 346 can actuate the irrigation subsystem 310*c* to supply water until level A is reached, and this can be done prior to the heating subsystem 310*d* being actuated. Also, continued monitoring of the water level during heating provides an indication of whether or not there is any leak in the system. Moreover, it is important not to have too much water in the system 310, because that would mean that energy is being wasted due to flowing a greater volume of water than necessary to prevent freezing of the ground.

Thus, although two preferred embodiments of the invention have been described, it is to be understood that various changes may be made without departing from the scope of the invention as particularly set forth herein.

We claim:

1. A control system for draining, irrigating and heating an athletic field comprising:

a water impermeable barrier conforming to a compacted subsoil;

a fill layer above the barrier and providing a subjacent support for a playing surface of the athletic field;

a flow network located within the fill layer and supported on the barrier, a portion of the flow network being water permeable;

a gravity drain line operatively connected to the flow network and terminating in a drain, the gravity drain line being selectively connected to and disconnected from the flow network by a first valve;

a vacuum drain line operatively connected between the flow network and a vacuum source for vacuum-assisted drainage of the flow network via the vacuum drain line, the vacuum drain line being selectively connected to and disconnected from the flow network by a second valve;

at least one water level sensor located within the fill layer for detecting water levels within the fill layer over the barrier;

a controller operatively connected to the one water level sensor, the vacuum source and the first and second valves, the controller first, initiating gravity drainage of the flow network by causing the first valve to open and the second valve to close in response to the water level sensor detecting a first water level and second, initiating vacuum-assisted drainage of the flow network by causing the first valve to close and the second valve to open in response to the water level sensor detecting a second water level above the first water level;

at least one temperature probe located within the fill layer and operatively connected to the controller;

a heating source operatively connected to the flow network and the controller;

a pump operatively connected to the flow network and the controller;

whereby upon detection by the temperature probe of a predetermined low temperature, the controller initiates closing of the first and second valves and actuation of the heating source and the pump, thereby to cause the flow of heated water into the flow network and the fill layer and the return of cooled water out of the fill layer and the flow network, in a closed loop, thereby to heat the field.

2. A control system for draining, irrigating and heating an athletic field comprising:

a water impermeable membrane covering a compacted subsoil at a predetermined vertical level;

a fill layer covering the membrane and terminating at a top surface for the field;

a flow network located within the fill layer and on the membrane, a portion of the fill layer being water permeable;

a gravity drainage subsystem coupled to the flow network;

a vacuum-assisted drainage subsystem coupled to the flow network parallel to the gravity drain subsystem;

an irrigation subsystem;

a plurality of water level sensors located within the fill layer at spaced locations around the field, each water level sensor supported on the membrane and adapted to measure the vertical water level with respect to the membrane and to generate in response thereto one of the following four reference signals: maintain, gravity drain, vacuum-assisted drain and irrigate corresponding to first, second, third and fourth vertical water levels above the predetermined vertical level, respectively, the second vertical level located further above the membrane than the first vertical level, the third vertical level located above the second level, and the fourth vertical level located closer to the barrier than the first vertical level;

a controller operatively connected to the water level sensors, the gravity drain subsystem, the vacuum-assisted drainage subsystem and the irrigation subsystem, to activate the gravity drainage subsystem when the water level above the membrane reaches the second vertical level, the vacuum-assisted drainage subsystem when the water level reaches the third vertical level and the irrigation subsystem when the water level above the membrane recedes to the fourth vertical level;

at least one temperature probe located in the fill layer, the temperature probe operatively connected to the controller;

a field heating subsystem including a heater and a pump in fluid communication with the flow network and operatively connected to the controller, whereby upon detection by the temperature probe of a predetermined low temperature, the controller actuates the field heating subsystem to pump heated water to the flow network and into the fill layer, and to also receive cooled water from the fill layer and the network in a closed loop manner, thereby to heat the fill layer and the top surface thereabove.

3. The control system of claim 2 and further comprising:

at least one additional temperature probe located above ground for detecting air temperature, and operatively connected to the controller to provide a low temperature signal upon detection thereof.

4. A method of heating an athletic field having a water impermeable membrane covering a compacted subsoil, a fill layer covering the membrane and terminating at a top surface for the field, a flow network located within the fill layer and above the membrane, the flow network including a plurality of water permeable conduits and first and second sets of pipes, the method comprising the steps of: flowing heated water into the flow network via the first and second sets of pipes and eventually into the fill layer to heat the field, while simultaneously draining relatively cooled water from the fill layer via the flow network;

monitoring, via at least one water level sensor, a water level with respect to the membrane and generating a corresponding water level signal for input to a controller:

selectively activating, depending upon variations in the water level and the corresponding water level signals produced thereby, a gravity drainage subsystem or a vacuum-enhanced drainage subsystem thereby to affect gravity drainage of the field or vacuum-enhanced drainage of the field, the gravity drainage subsystem and the vacuum-enhanced drainage subsystem each including the second set of pipes and excluding the first set of pipes.

5. The method of claim 4 and further comprising the step of:

initiating the flowing step in response to detection of a predetermined low temperature.

6. The method of claim 4 and further comprising the step of:

maintaining a sufficient water level with respect to the membrane to keep the entire flow network submerged during the flowing step.

7. The method of claim 4 wherein the flowed water is heated by a heat source to raise the temperature of the water by a temperature value in the range of about 5–15° F.

8. The method of claim 4 wherein the heated water is flowing at a rate to maintain a heat loss from the water in the range of about 5–15° F.

9. The method of claim 4 and further comprising the step of:

selectively activating, depending upon variations in the water level and the corresponding water level signals produced thereby, an irrigation subsystem, thereby to affect subirrigation of the field.

10. A system for draining and heating an athletic field, the field having a water impermeable membrane covering a compacted subsoil, a fill layer covering the membrane and terminating at a top surface for the field, a flow network located within the fill layer and above the membrane, the flow network including a plurality of water permeable conduits, comprising:

the flow network including a plurality of parallel rows of water permeable conduits located above the compacted subsoil, a plurality of parallel rows of water impermeable pipes partially recessed within the subsoil and being perpendicular to and intersecting the plurality of parallel rows of conduits, thereby defining a plurality of network intersections, whereby at a first plurality of the intersections the conduit row overlays and does not interconnect with the respective pipe row, the flow network also including a plurality of couplings, each coupling located at one of a second plurality of intersections of a pipe row and a conduit row and providing a fluid interconnection thereat wherein the first and second intersections are alternated along the pipe rows and the conduit rows; and means for flowing heated water into a first group of the pipe rows, via a first group of the conduit rows in fluid communication therewith via a heating group of the first intersections and eventually causing the heated water to flow into the fill layer, while simultaneously draining cooled water from the fill layer via a second group of the conduit rows and to a second group of the pipe rows in fluid communication therewith via a draining group of the first intersections, the flow of heated water and cooled water occurring continuously in a loop, thereby to heat the field.

11. The system of claim 10 and further comprising: control means operatively connected to the means for flowing heated water, the control means including a temperature probe for detecting a predetermined low temperature and the control means adapted to actuate the means for flowing heated water in response to said low temperature detection.

12. The system of claim 11 wherein the control means further cooperates with a field drainage subsystem and a field irrigation subsystem, and the control means monitors water level with respect to the membrane while also detecting temperature, thereby to control draining, irrigating and heating of the field.

13. The system of claim 10 and further comprising:

a plurality of reinforcement plates, each reinforcement plate located at a first intersection and providing additional structural rigidity for the coupling located thereat.

14. A control system for draining, irrigating and heating an athletic field comprising:

a water impermeable barrier conforming to a compacted subsoil;

a fill layer above the barrier and providing a subjacent support for a playing surface of the athletic field;

a flow network located within the fill layer and supported on the barrier, a portion of the flow network being water permeable, the flow network including a first set of pipes and a second set of pipes;

a gravity drain line operatively connected to the flow network and terminating in a drain, the gravity drain line being selectively connected to and disconnected from the flow network by a first valve;

a vacuum drain line operatively connected between the flow network and a vacuum source for vacuum-assisted drainage of the flow network via the vacuum drain line, the vacuum drain line being selectively connected to and disconnected from the flow network by a second valve;

at least one water level sensor located within the fill layer for detecting water levels within the fill layer over the barrier;

a controller operatively connected to the one water level sensor, the vacuum source and the first and second valves, the controller first, initiating gravity drainage of the flow network by causing the first valve to open and the second valve to close in response to the water level sensor detecting a first water level and second, initiating vacuum-assisted drainage of the flow network by causing the first valve to close and the second valve to open in response to the water level sensor detecting a second water level above the first water level;

at least one temperature probe located within the fill layer and operatively connected to the controller;

a heating source operatively connected to the first set of pipes of the flow network and the controller;

a pump operatively connected to the flow network and the controller;

whereby upon detection by the temperature probe of a predetermined low temperature, the controller initiates closing of the first and second valves and actuation of the heating source and the pump, thereby to cause the flow of heated water into the flow network and the fill layer and the return of cooled water out of the fill layer and the flow network, in a closed loop, thereby to heat the field, the first set of pipes being dedicated to the flow of heated water and the second set of pipes being used alternatively for the flow of heated water, gravity drainage or vacuum assisted drainage.

* * * * *

UNITED STATES PATENT AND TRADEMARK OFFICE

CERTIFICATE OF CORRECTION

PATENT NO. : 5,944,444

DATED : August 31, 1999

INVENTOR(S) : Joseph E. Motz, et. al.

It is certified that error appears in the above-identified patent and that said Letters Patent is hereby corrected as shown below:

Column 1, line 7, reads "January, 17," and should read --February 17,-- as amended in Amendment dated March 1, 1999, in the specification at page 2, line 2.

Column 18, line 22 reads "presence the water" and should read --presence of the water--.

Column 21, line 33, "subsystems, 15, 27 246," should read --subsystems 15, 27, 246,--.

Column 21, line 42, reads "to fund components," and should read --to find components--

Signed and Sealed this

First Day of May, 2001

*Attest:*

Nicholas P. Godici

NICHOLAS P. GODICI

*Attesting Officer*

*Acting Director of the United States Patent and Trademark Office*